US010394176B2

(12) United States Patent
Matsumoto

(10) Patent No.: US 10,394,176 B2
(45) Date of Patent: Aug. 27, 2019

(54) IMAGE FORMING APPARATUS WITH ADJUSTMENT OF TONER CONTENT IN DEVELOPER

(71) Applicant: CANON KABUSHIKI KAISHA, Tokyo (JP)

(72) Inventor: Atsushi Matsumoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/643,846

(22) Filed: Jul. 7, 2017

(65) Prior Publication Data

US 2018/0017924 A1 Jan. 18, 2018

(30) Foreign Application Priority Data

Jul. 13, 2016 (JP) ..... 2016-138909

(51) Int. Cl.
*G03G 15/00* (2006.01)

(52) U.S. Cl.
CPC ..... *G03G 15/556* (2013.01)

(58) Field of Classification Search
CPC ..... G03G 15/556
USPC ..... 399/53
See application file for complete search history.

(56) References Cited

U.S. PATENT DOCUMENTS

2008/0124107 A1* 5/2008 Takeuchi ..... G03G 15/1605 399/59

FOREIGN PATENT DOCUMENTS

| | | | | |
|---|---|---|---|---|
| JP | 01-182750 A | | 7/1989 | |
| JP | 05-27527 A | | 2/1993 | |
| JP | 06-149057 A | | 5/1994 | |
| JP | 2011-048118 A | | 3/2011 | |
| JP | 2016090860 A | * | 5/2016 | ..... G03G 15/0862 |

* cited by examiner

*Primary Examiner* — Susan S Lee
(74) *Attorney, Agent, or Firm* — Venable LLP

(57) ABSTRACT

An image forming apparatus includes an image bearing member, a developing device, a toner content detecting portion, a toner supplying device, an image ratio calculating portion, a toner image density detecting portion, an adjusting portion, and a controller. The controller is configured to control an execution frequency of the adjusting portion so that execution by the adjusting portion is carried out after a number of times of image formation after occurrence of a change rate of the image ratio that is greater than a predetermined change rate reaches a first value, and execution by the adjusting portion is carried out after the number of times of image formation after occurrence of a change rate of the image ratio that is less than the predetermined change rate reaches a second value greater than the first value.

39 Claims, 21 Drawing Sheets

(a)

(b)

(a)

(b)

IMAGE FORMING APPARATUS WITH ADJUSTMENT OF TONER CONTENT IN DEVELOPER

FIELD OF THE INVENTION AND RELATED ART

The present invention relates to an image forming apparatus, such as a copying machine, a printer or a facsimile machine, in which an electrostatic image on an image bearing member is developed with a developer containing toner and a carrier.

Conventionally, as the image forming apparatus of an electrophotographic type, there is an image forming apparatus in which image formation (printing) is carried out by developing the electrostatic image on the image bearing member with a two-component developer principally containing the toner and the carrier (hereinafter, also referred to simply as a "developer").

In such an image forming apparatus, a toner charge amount is maintained at a substantially certain value by adjusting a toner content of the developer in a developing device so that the electrostatic image formed under a roller charging/exposure condition is developed at a predetermined toner amount per unit area. The toner amount per unit area is a weight of the toner per unit area. Further, the "toner content" is a ratio of the weight of the toner to a weight of the developer and is also referred to as a "TD print". Further, the "toner charge amount" is a charge amount per unit area of the toner.

Control of maintaining the toner charge amount at the substantially certain value is carried out in the following manner. When the toner charge amount decreases, the toner amount per unit area increases and an image density increases even when the same electrostatic image is used, and therefore, the toner charge amount can be increased by increasing the TD ratio and thus by reducing an opportunity of friction of the developer. As supply control of supplying a supply developer to the developing device, the following control methods (systems) (Japanese Laid-Open Patent Applications (JP-A) Hei 01-182750, JP-A Hei 06-149057, JP-A Hei 05-027527 and JP-A 2011-48118) are known.

As a first method, control of adjusting a supplying amount of the supply developer, in which the TD ratio is measured by detecting a change in apparent permeability of the developer by an inductance detecting means (i.e., an induction control method), has been known (JP-A Hei 01-182750).

As a second method, control of supplying the supply developer so that an image density of a predetermined patch image (reference toner image) formed during non-image formation is detected by an image density detecting means and the detected image density converges to a predetermined image density (i.e., a patch detection ATR control method) has been known (JP-A Hei 06-149057). The ATR refers to an abbreviation of "Auto Toner Replenishing".

As a third method, control of supplying the supply developer correspondingly to a toner consumption amount calculated by counting a video count value by a video counting means (i.e., a video count control method) has been known (JP-A Hei 05-027527). The video count value is typically an integrated value of development dot number (or an integrated value of an exposure time (exposure area) depending on the image density) of an entirety of a binary-modulated image supplied to a light source of an exposure device.

As a fourth method, control of stabilizing the image density of an output image with a good balance by using the above-described first, second and third methods in combination (i.e., a triple control method) has been known (JP-A 2011-48118). That is, the toner consumption amount is estimated using the video count control method and then the supply developer in an amount corresponding to the estimated toner consumption amount is supplied in a feed-forward manner. Further, a deviation from a target value of the TD ratio (hereinafter, also referred to as a "target TD ratio") is corrected in a feed-back manner by using the inductance control method. Further, the target TD ratio in the inductance control method is changed depending on the image density of the patch image detected by the patch detection ATR control method.

However, even when the triple control method is employed, the image density of the output image fluctuates in some cases. This phenomenon is liable to generate when an image with a high print toner (hereinafter, also referred to as a "high print ratio image" is continuously printed (formed) immediately after an image with a low print ratio (hereinafter, also referred to as a "low print ratio image" is continuously printed (formed).

That is, the change in target TD ratio in the inductance control method by the patch detection ATR control method is carried out at a predetermined frequency. The toner charge amount of the developer in the developing device tends to increase during continuous printing of the low print ratio image and tends to decrease during continuous printing of the high print ratio image. For that reason, by the patch detection ATR control method, there is a tendency that the target TD ratio is set at a high value during the continuous printing of the low print ratio image and is set at a low value during the continuous printing of the high print ratio image. However, in the case where the continuous printing of the low print ratio image is switched to the continuous printing of the high print ratio image, the target TD ratio set at the high value is not changed in time to the target toner density ratio with the value in some instances. As a result, the toner charge amount of the developer in the developing device excessively lowers, so that the image density of the output image increases in some instances.

On the other hand, there is a method of increasing an execution frequency of the patch detection ATR control method during the printing of the high print ratio image. However, the time when the change in toner charge amount of the developer in the developing device as described above is largest is immediately after the continuous printing is changed from that of the low print ratio image to that of the high print ratio image. Thereafter, when the printing of the high print ratio image is continued for a certain time, the toner charge amount of the developer in the developing device becomes stable. For that reason, when the execution frequency of the patch detection ATR control method is uniformly increased during the printing of the high print ratio image, the patch detection ATR control method is executed at a high frequency more than necessary although the toner charge amount is stable, so that this is not preferable from the viewpoints of productivity and toner consumption.

SUMMARY OF THE INVENTION

A principal object of the present invention is to provide an image forming apparatus capable of suppressing a density fluctuation of an image to be outputted in the case where an image ratio fluctuates.

According to an aspect of the present invention, there is provided an image forming apparatus comprising: an image bearing member; a developing device configured to develop, with a developer containing toner and a carrier, an electrostatic latent image formed on the image bearing member; a toner content detecting portion configured to detect a toner content in the developer in the developing device; a supplying device configured to supply the toner to the developing device on the basis of an output of the toner content detecting portion so that the toner content in the developer in the developing device is a target value; a calculating portion configured to calculate an image ratio of an image to be outputted; a toner image detecting portion configured to detect a density of a toner image formed by the developing device; an adjusting portion configured to adjust the target value on the basis of a result of detection of a density of a detection toner image by the toner image detecting portion, the detection toner image being formed by the developing device; and a controller configured to control an execution frequency of the adjusting portion so that the adjusting portion is carried out after a number of times of image formation after occurrence of a larger change rate of the image ratio than a predetermined change rate reaches a first value, and the adjusting portion is carried out after the number of times of image formation after occurrence of a smaller change rate of the image ratio than the predetermined change rate reaches a second value larger than the first value.

Further features of the present invention will become apparent from the following description of exemplary embodiments with reference to the attached drawings.

DESCRIPTION OF EMBODIMENTS

An image forming apparatus according to the present invention will be described specifically with reference to the drawings.

Embodiment 1

1. General Constitution and Operation of Image Forming Apparatus

Figure 1:
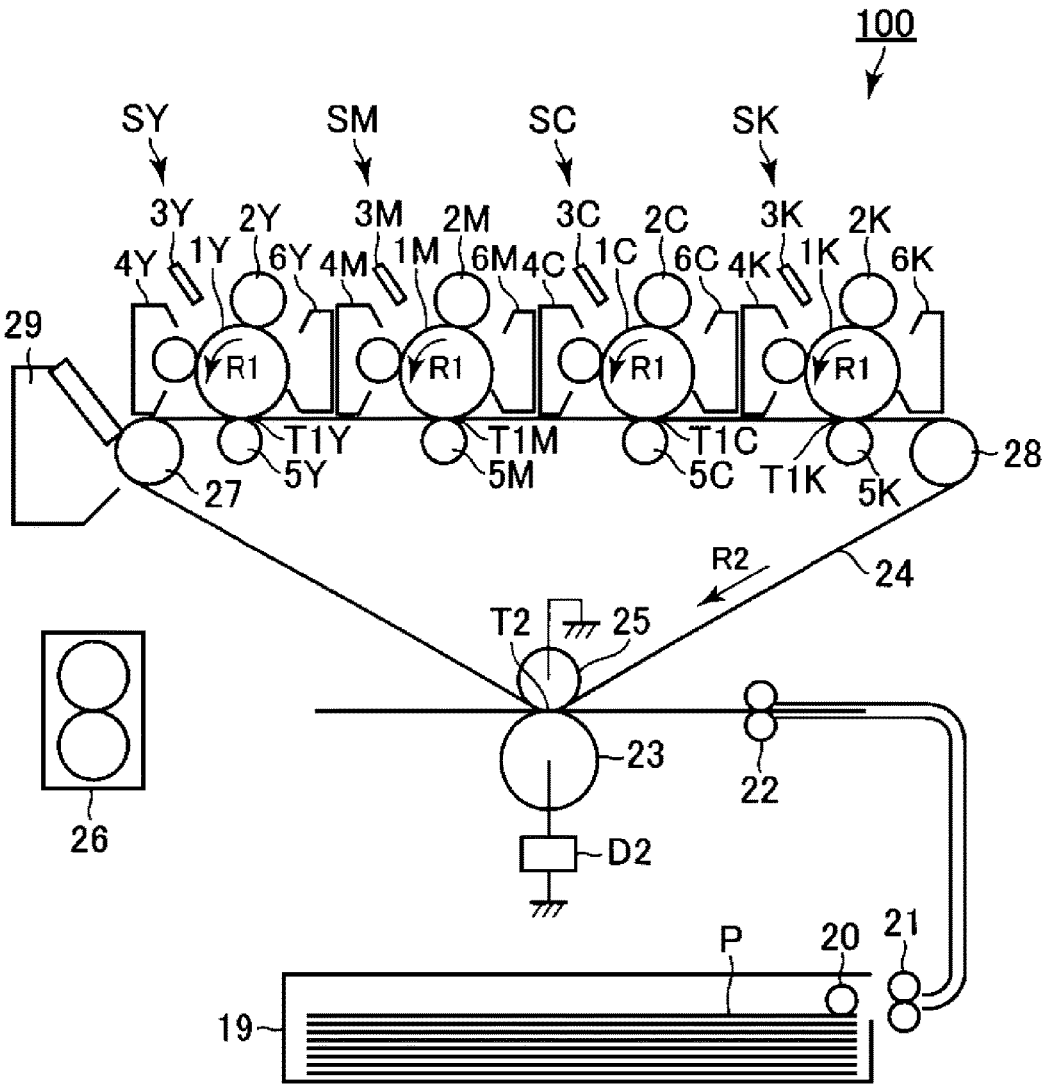
FIG. 1 is a schematic sectional view of an image forming apparatus.

FIG. 1 is a schematic sectional view of an image forming apparatus 100 in this embodiment according to the present invention.

The image forming apparatus 100 in this embodiment is a tandem printer capable of forming a full-color image using an electrophotographic type and an intermediary transfer type.

Figure 2:
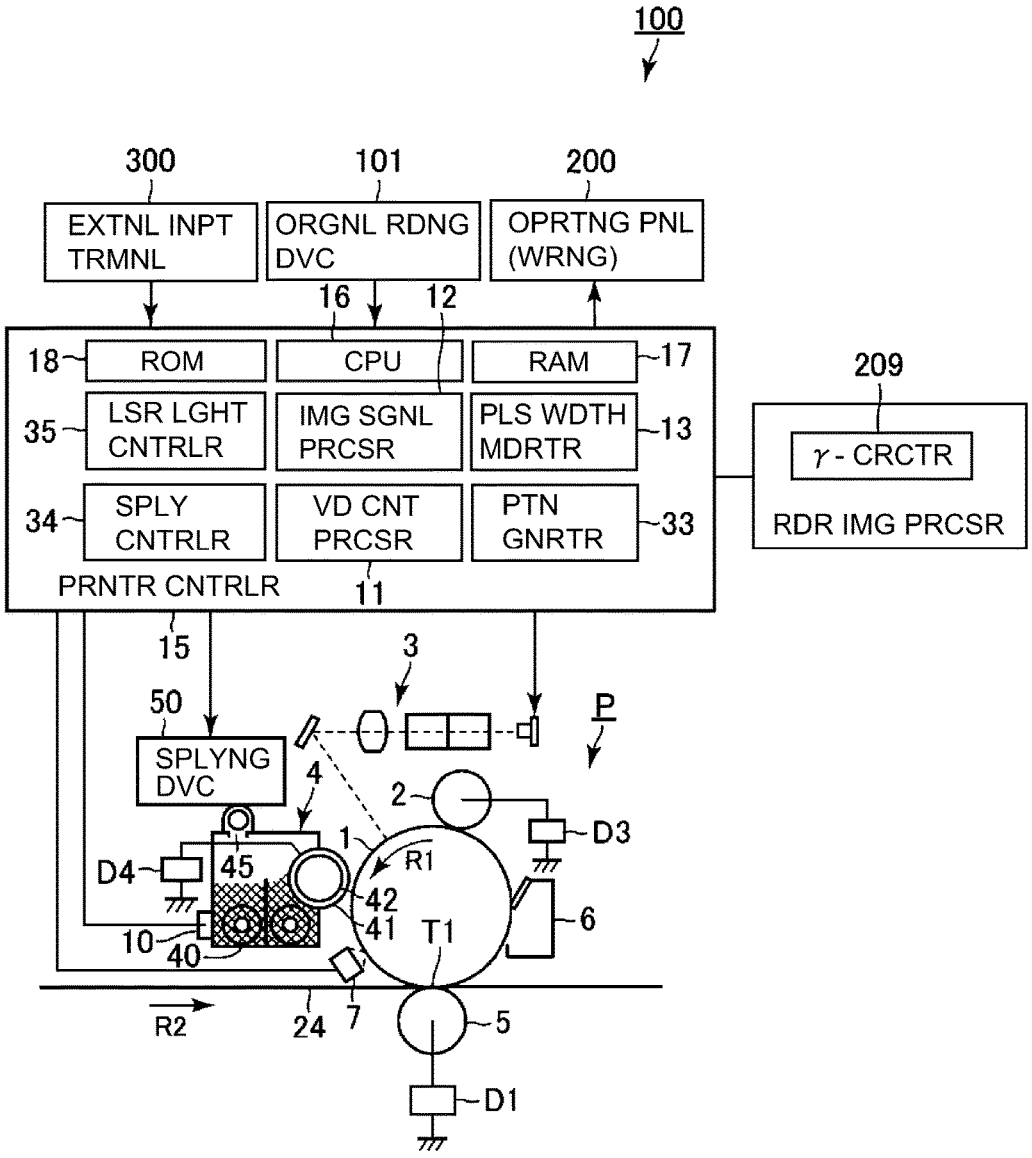
FIG. 2 is a schematic view showing a constitution of an image forming portion and a constitution of a control system.

The image forming apparatus 100 includes first to fourth image forming portions SY, SM, SC and SK for forming images of yellow (Y), magenta (M), cyan (C) and black (K), respectively, as a plurality of image forming portions (stations). In the respective image forming portions SY, SM, SC and SK, elements having the same or corresponding functions or constitutions are collectively described in some instances by omitting suffixes Y, M, C and K for representing the elements for associated colors. In this embodiment, the image forming portion S is constituted by including a photosensitive drum 1 (described later), a charging roller 2, an exposure device 3, a primary transfer roller 5, and a drum cleaning device 6. FIG. 2 is a schematic sectional view of the image forming portion S shown together with a block diagram of a control system of the image forming portion S.

The photosensitive drum 1 which is a drum-type photosensitive member as a first image bearing member for carrying a toner image is rotationally driven in an indicated arrow R1 direction (counterclockwise direction) at a predetermined peripheral speed (process speed). In this embodiment, the photosensitive drum 1 is constituted by forming a photosensitive layer, having negative chargeability as a charge polarity, on an outer peripheral surface of an aluminum cylinder. In this embodiment, the process speed is 300 mm/sec. The surface of the rotating photosensitive drum 1 is uniformly charged to a predetermined negative dark-portion potential VD by the charging roller 2 as a charging means. During a charging step, to the charging roller 2, from a charging voltage source D3, a charging voltage (charging bias) which is an oscillating voltage in the form of a negative DC voltage biased with an AC voltage is applied. The charged surface of the photosensitive drum 1 is subjected to scanning exposure depending on image information by the exposure device 3, so that on the photosensitive drum 1, an electrostatic image (electrostatic latent image) is formed.

The electrostatic image formed on the photosensitive drum 1 is developed (visualized) with a toner as a developer by the developing device 4 as a developing means. In this embodiment, a developing device 4 uses a two-component developer in which toner (non-magnetic toner particles) and a carrier (magnetic carrier particles) are mixed with each other. In this embodiment, the toner charged to the same polarity (negative in this embodiment) as the charge polarity of the photosensitive drum 1 is deposited on an exposed portion of the photosensitive drum 1 lowered in absolute value of the potential by the exposure to light after the photosensitive drum 1 is uniformly charged (reverse development).

An intermediary transfer belt 24 which is an intermediary transfer member constituted by an endless belt as a second image bearing member for carrying the toner image is provided so as to oppose the photosensitive members 1 of the respective image forming portions S. The intermediary transfer belt 24 is extended and stretched with predetermined tension by, as a plurality of stretching rollers, a tension roller 27, a driving roller 28, and a secondary transfer opposite roller 25. The intermediary transfer belt 24 is rotated (circulated and moved) in an arrow R2 direction (clockwise direction) at a peripheral speed (process speed) which is the same as the peripheral speed of the photosensitive drum 1 by rotationally driving the driving roller 28. In an inner peripheral surface side of the intermediary transfer belt 24, primary transfer rollers 6 as primary transfer means are provided correspondingly to the respective photosensitive drums 1. Each of the primary transfer rollers 5 is urged toward the corresponding photosensitive drum 1 via the intermediary transfer belt 24, and forms a primary transfer portion (primary transfer nip) T1 where the intermediary transfer belt 24 and the photosensitive drum 1 are in contact with each other. The toner image formed on the photosensitive drum 1 as described above is transferred (primary-transferred) from the photosensitive drum 1 onto the rotating intermediary transfer belt 24 at the primary transfer portion T1. During a primary transfer step, to the primary transfer roller 5, from a primary transfer voltage source D1, a primary transfer voltage (primary transfer bias) which is a DC voltage of an opposite polarity (positive in this embodiment) to a charge polarity (normal charge polarity) of the toner during the development is applied. For example, during full-color image formation, the toner images of the respective colors of yellow, magenta, cyan and black which are formed on the respective photosensitive drums 1 are successively transferred superposedly onto the intermediary transfer belt 24.

In an outer peripheral surface side of the intermediary transfer belt 24, at a position opposing the secondary transfer opposite roller 25, a secondary transfer roller 23 as a secondary transfer means is provided. The secondary transfer roller 23 is urged toward the secondary transfer opposite roller 25 via the intermediary transfer belt 24, and forms a secondary transfer portion (secondary transfer nip) T2 where the intermediary transfer belt 24 and the secondary transfer roller 23 are in contact with each other.

The toner images formed on the intermediary transfer belt 24 as described above are transferred (secondary-transferred), at the secondary transfer portion T2, onto the recording material P such as paper sandwiched and fed by the intermediary transfer belt 24 and the secondary transfer roller 23. During a secondary transfer step, to the secondary transfer roller 23, a secondary transfer voltage (secondary transfer bias) which is a DC voltage of the opposite polarity (positive in this embodiment) to the normal charge polarity of the toner is applied from a secondary transfer voltage source D2. The recording material P is accommodated in a cassette 19 as a recording material accommodating portion and is fed from the cassette 19 by a pick-up roller 20 and is separated one by one by a separating roller 21, and then is fed to a registration roller pair 22. Then, the recording material P is supplied to the secondary transfer portion T2 while being timed to the toner images on the intermediary transfer belt 24 by the registration roller pair 22.

The recording material P on which the toner images are transferred is fed to a fixing device 26 as a fixing means and is heated and pressed by this fixing device 26, so that the toner image is fixed (melt-fixed) and thereafter the recording material P is discharged (outputted) to an outside of an apparatus main assembly 110 of the image forming apparatus 100.

On the other hand, a deposited matter such as the toner (primary transfer residual toner) remaining on the surface of the photosensitive drum 1 after the primary transfer step is removed and collected from the surface of the photosensitive drum 1 by a drum cleaning device 6 as a photosensitive member cleaning means. Further, the deposited matter such as the toner (secondary transfer residual toner) remaining on the surface of the intermediary transfer belt 24 after the secondary transfer step is removed and collected from the surface of the intermediary transfer belt 24 by a belt cleaning device 29 as an intermediary transfer member cleaning means.

In this embodiment, the charging roller 2, the exposure device 3 and the like constitute an electrostatic image forming means for forming the electrostatic image depending on image information on the image bearing member.

As shown in FIG. 2, the image forming apparatus 100 includes a printer controller 15 including a CPU 16 as a control means, and a RAM 17 and a ROM 18 as storing means, and the like. The printer controller 15 carries out integrated control of operations of the respective portions of the image forming apparatus 100.

2. Exposure Device

As shown in FIG. 2, in this embodiment, the exposure device 3 is a laser scanner including a rotating mirror. A laser light quantity control circuit 35 determines an exposure output of the exposure device 3 so as to acquire a desired image density level with respect to a laser output signal. Further, a pulse width modulating circuit 13 of the printer controller 15 determines a pulse width of binary laser light outputted from the exposure device 3 in accordance with a driving signal generated using gradation correction table (γ-LUT) of a γ-correction circuit 209 connected with the printer controller 15. On the basis of a preliminarily obtained relationship between the laser output signal and the image density level, information on the laser output signal providing a desired image density is stored in the γ-correction circuit 209 as the gradation correction table (γ-LUT). In accordance with this gradation correction table (γ-LUT), the laser output signal is determined.

The input image signal is sent to the printer controller 15. The exposure device 3 writes (forms) the electrostatic image for an image on the charged photosensitive drum 1 through binary area gradation using PWM (pulse width modulation). As a result, image recording with density gradation is carried out. That is, the pulse width modulating circuit 13 of the printer controller 15 forms and outputs a laser driving pulse with a width (time width) corresponding to a level of an inputted pixel image signal for each of inputted pixel image signals. The pulse width modulating circuit 13 forms a broader width driving pulse for a high density pixel signal, a narrower width driving pulse for a low density pixel signal and an intermediary width driving pulse for an intermediary density pixel signal. The binary laser driving pulse outputted from the pulse width modulating circuit 13 is supplied to a semiconductor laser of the exposure device 3. The exposure device 3 causes the semiconductor laser to emit laser light for a time corresponding to a pulse width of an output signal of the pulse width modulating circuit 13 (i.e., the semiconductor laser is turned on in the case where the output signal is H-level and is turned off in the case where the output signal is L-level). Accordingly, the semiconductor laser is driven for a longer time with respect to the high density image and is driven for a shorter time with respect to the low density image. For this reason, a dot size (area) of the electrostatic image formed on the photosensitive drum 1 is different correspondingly to the pixel density. The exposure device 3 exposes the photosensitive drum surface to light in a longer range with respect to the high density pixel in a main scan direction and in shorter range with respect to the low density pixel in the main scan direction.

3. Original Reading Device

As shown in FIG. 2, a copy original G to be read is read by an original reading device (reader portion) 101 provided as a part of the image forming apparatus 100. The original reading device 101 includes a photoelectric conversion element for converting an original image from a CCD sensor or the like into an electric signal, and outputs an image signal corresponding to each of pieces of image information of the original G for each of the colors of yellow, magenta, cyan and black.

Figure 3:
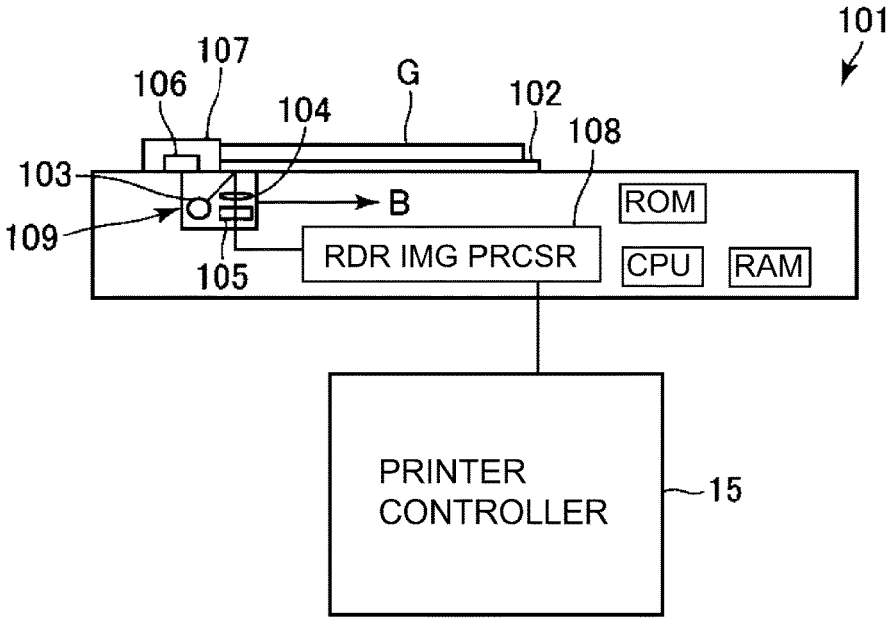
FIG. 3 is a schematic view of an original reading device.

FIG. 3 is a schematic view of the original reading device 101. When the original G placed on an original carriage 102 is irradiated with light from a light source 103, reflected light from the original G is formed and detected as an image on a CCD sensor 105 through an optical system 104 such as a lens. A reading portion 109 constituted by including the light source 103, the optical system 104 and the CCD sensor 105 and the like is moved in an arrow B direction in FIG. 3, and scans an entire region of the original G. As a result, image information in the entire region of the original G is converted into image data consisting of data sequence corresponding to each line of scanning. The thus-acquired image data is sent to the printer controller 15 after being image-processed by a reader image processing portion 108, so that a predetermined image processing is carried out by the printer controller 15. Specifically, when the reflected light from the original G is formed as the image on the CCD sensor 105, information on the original G is acquired as a brightness value by the CCD sensor 105. The brightness value is converted into a density value by the reader image processing portion 108 (conversion from the brightness into amount per unit area). The reader image processing portion 108 converts the brightness value into the density value by using a table for density value conversion (LUTid_r) and delivers the converted density value as 8 bit-image data to the printer controller 15.

The image forming apparatus 100 not only has a function as a copying machine for forming an image depending on image information which is detected by the image reading device 101 and which is changed into image data but also has a function as a facsimile machine and a printer. That is, the image forming apparatus 100 also subjects image data received from a telephone line (FAX) via an unshown receiving portion to a predetermined image processing by the printer controller 15 similarly as described above and thus is capable of forming the image. Further, the image forming apparatus 100 also subjects image data received from an external input terminal 300 via an unshown network (printer server or the like) to a predetermined image processing by the printer controller 15 similarly as described above and thus is capable of forming the image.

4. Developing Device

Figure 4:
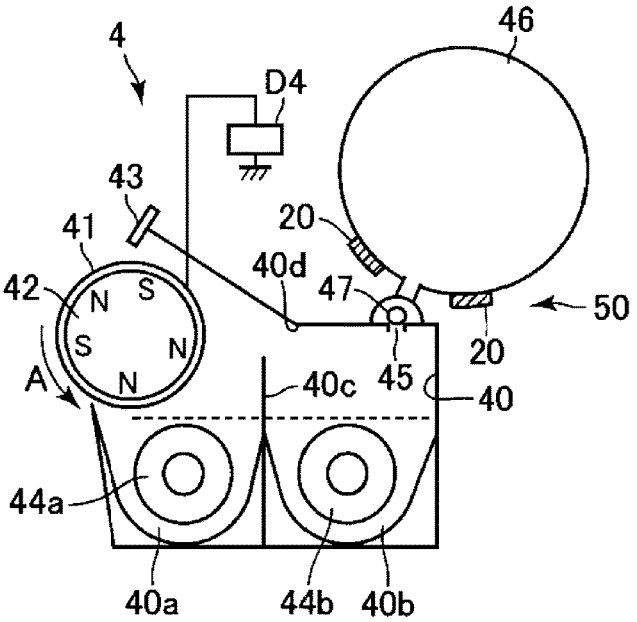
FIG. 4 is a schematic sectional view of a developing device.

FIG. 4 is a schematic sectional view of the developing device 4. The developing device 4 includes a developing container 40. In the developing container 40, a developer (two-component developer) principally including toner and a carrier is accommodated. In this embodiment, a TD ratio of the developer in the developing device 4 in an initial state (unused state) is 8%. The TD ratio should be properly adjusted depending on a toner charge amount, a carrier particle size, a structure of the developing device 4 or the like, and therefore is not limited to 8%.

The developing container 40 is provided with an opening at a position opposing the photosensitive drum 1 and includes a developing sleeve 41, as a developer carrying member constituted by a non-magnetic material, provided rotatably so as to be partly exposed to an outside through the opening. At a hollow portion of the developing sleeve 41, a magnet roller 42 as a magnetic field generating means is fixedly provided toward the developing container 40. The magnet roller 42 is constituted by a cylindrical magnet having a plurality of magnetic poles with a predetermined pattern along a circumference of the developing sleeve 41. The carrier having a surface on which the toner is adsorbed by triboelectric charge is confined on the developing sleeve 41 by a magnetic field generated by the magnet roller 42. During a developing operation, the developing sleeve 41 rotates in an arrow A direction in FIG. 4. The developing sleeve 41 holds the developer in the developing container 40 in the form of a layer and feeds the developer, so that the developer is fed to a developing region opposing the photosensitive drum 1. A layer thickness of the developer carried by the developing sleeve 41 is regulated by a regulating member 43 provided so as to oppose the photosensitive drum 1 in proximity to the photosensitive drum 1. Further, during the developing operation, to the developing sleeve 41, from a developing voltage source D4, a developing voltage (developing bias) which is an oscillating voltage in the form of a negative DC voltage Vdc biased with an AC voltage is applied. The developing sleeve 41 to which the negative DC voltage Vdc is applied is negative relative to an electrostatic image exposure portion formed on the photosensitive drum 1. For that reason, the negatively charged toner in the developer is moved from the developing sleeve 41 onto the exposure portion on the photosensitive drum 1. The developer remaining on the developing sleeve 41 after passing through the developing region is collected in the developing container 40 by rotation of the developing sleeve 41 and is mixed with the developer fed by a first stirring screw 44*a* (described later).

In the developing container 40, first and second stirring screws 44*a* and 44*b* as stirring and feeding members for feeding the developer while stirring the developer are provided substantially in parallel to the developing sleeve 41. A space in the developing container 40 is partitioned into two spaces consisting of a developing chamber 40*a* and a stirring chamber 40*b* by a partition wall 40*c*. The first stirring screw 44*a* is disposed in the developing chamber 40*a* which is the space in the developing sleeve 41 side, and the second stirring screw 44*b* is disposed in the stirring chamber 40*b* which is the other space. At longitudinal end portions of the partition wall 40*c*, unshown openings are formed so as to deliver the developer between the developing chamber 40*a* and the stirring chamber 40*b*. The first stirring screw 44*a* supplies the developer to the developing sleeve 41 while feeding the developer from the rear side of the front side on the drawing sheet of FIG. 4. The second stirring screw 44*b* mixes a supply developer, supplied from a developer cartridge 46 (described later) with the developer fed in the stirring chamber 40*b* while feeding the developer from the front side to the rear side on the drawing sheet of FIG. 4. Thus, the first and second stirring screws 44*a* and 44*b* not only circulate the developer in the developing container 40 but also stir and triboelectrically charge the toner and the carrier.

As shown in FIG. 4, into the developing device 4, the supply developer containing the toner is supplied from the developer cartridge 46. In this embodiment, the carrier is not contained in the supply developer, but a constitution in which a supply developer containing the toner and the carrier is supplied to the developing device 4 may also be employed. The developer cartridge 46 is constituted by a substantially cylindrical bottle in this embodiment and is easily detachably mountable to the apparatus main assembly of the image forming apparatus 100 through a mounting portion 20 provided in the apparatus main assembly of the image forming apparatus 100.

In the developing device 4, an upper wall 40*d* of the developing container 40 in the neighborhood of the second stirring screw 44*b* is provided with a developer supplying opening 45 for receiving the supply developer from the developer cartridge 46. Further, in the developing device 4, a supplying screw 47 as a supplying member is provided for feeding the supply developer from the developer cartridge 46 into the developing container 40 through the developer supplying opening 45. In this embodiment, a supplying device 50 is constituted by the developer cartridge 46, the supplying screw 47 and the like.

The supply developer in an amount corresponding to an amount of the developer consumed by image formation is supplied from the developer cartridge 46 into the developing container 40 through the developer supplying opening 45. In this embodiment, as a supplying method, a block supplying type (method) is employed. The block supplying type refers to a type in which the developer in an arbitrary supply amount is not supplied on an as needed basis, but supply of the developer is refrained until the supply amount reaches a predetermined one-block supply amount (200 mg in this embodiment) and is carried out by rotating the supplying screw 47 through one-full-circumference for every one-block supply amount of 200 mg. That is, the supply amount of the developer by the supplying screw 47 increases and decreases in one cycle period depending on a rotational phase of the supplying screw 47 in some cases. For that reason, in order to obtain a stable supply amount, the block supplying type, in which the developer is always supplied every one cyclic period, may preferably be used. In this embodiment, a maximum number of supply blocks of the developer supplied per (one) sheet is 2 blocks for an A4 size and 4 blocks for an A3 size.

5. Two-Component Developer

The toner contains colored resin particles made up of a binder resin, a coloring agent, and other additives as desired, and may further contain external additives such as fine powder of colloidal silica. In this embodiment, as the binder resin, a polyester resin material is used, and the toner is a negatively chargeable toner manufactured by a pulverizing method. The toner may preferably have a volume-average particle size of not less than 4 μm and not more than 8 μm. In this embodiment, the volume-average particle size is 5.5 μm.

The volume-average particle size was measured with the use of a Coulter Counter TA-II (mfd. by Beckman Coulter Inc.). Further, an interface (mfd. by Nikkaki-Bios K.K.) for outputting the number and volume average distributions of the developer from a measured result and a personal computer ("CX-I", mfd. by Canon K.K.) were used. A measuring method is as follows. As an electrolytic aqueous solution for a measuring sample, 1% NaCl aqueous solution prepared by using a first class grade sodium chloride was used. That is, 0.1 ml of a surfactant, preferably alkyl-benzene sulfonate, was added, as dispersant, into 100-150 ml of above-mentioned electrolytic aqueous solution. Then, 0.5-50 mg of the measuring sample was added to the above mixture. Then, the electrolytic aqueous solution in which the sample was suspended was subjected to dispersion by an ultrasonic dispersing device for about 1-3 minutes and was set in the Coulter Counter TA-II. Then, the particle size distribution of the particles which were in a range of 2-40 μm in diameter was obtained with the use of the Coulter Counter TA-II fitted with a 100 μm aperture as an aperture. The volume-average particle size was obtained from the thus obtained volume-average distribution.

As the carrier, magnetic particles of surface-oxidized or surface-unoxidized metals, such as iron, nickel, cobalt, manganese, chromium or rare-earth metal, or alloys of these metals or oxide ferrites or the like, are usable. A manufacturing method of these magnetic particles is not particularly limited. The carrier is 20-50 μm, preferably 30-40 μm, in volume-average particle size, and is $1\times10^7$ Ωcm or more, preferably $1\times10^8$ Ωcm or more, in resistivity. In this embodiment, the carrier is 40 μm in volume-average particle size and $5\times10^8$ Ωcm in resistivity.

The volume-average particle size of the magnetic carrier was measured with the use of a particle size distribution measuring device ("HEROS", mfd. by JEOL Ltd.) of the laser diffraction type in the following manner. The particle size range of 0.5-350 μm was, based on volume basis, logarithmically divided into 32 decades, and the number of particles in each decade was measured. Then, from the results of the measurement, the median diameter of 50% in volume was used as the volume-average particle size. The resistivity of the magnetic carrier was measured in the following manner. That is, a cell of the sandwich type, which was 4 cm in the area (size) of each of its measurement electrodes, and was 0.4 cm in the gap between the electrodes, was used. Then, the resistivity was measured by a method in which the carrier resistivity was obtained from electric current which flowed through a circuit while under application of 1 kg of a weight and application of a voltage E (V/cm) between the two electrodes.

Incidentally, as a carrier with low specific gravity, a resin carrier manufactured through a polymerization method after a magnetic metal oxide and a non-magnetic metal oxide are mixed in a phenolic binder resin in a predetermined ratio may also be used. As an example, the resin carrier is 35 μm in volume-average particle size, 3.6-3.7 ($g/cm^3$) in true density and 53 ($A \cdot m^2/kg$) in magnetization amount. Further, the magnetization amount ($A \cdot m^2/kg$) of the magnetic carrier can be obtained by measuring the magnetic properties with the use of an automatic magnetic property recorder of a vibratory magnetic field type (BHV-30 mfd. by Riken Denshi Co., Ltd.). Magnetic properties can be obtained by measuring a strength of the magnetization of the carrier, packed in a cylindrical shape, in an external magnetic field of 79.6 kA/m (1000 oersted).

6. Faraday-Cage

Figure 24:
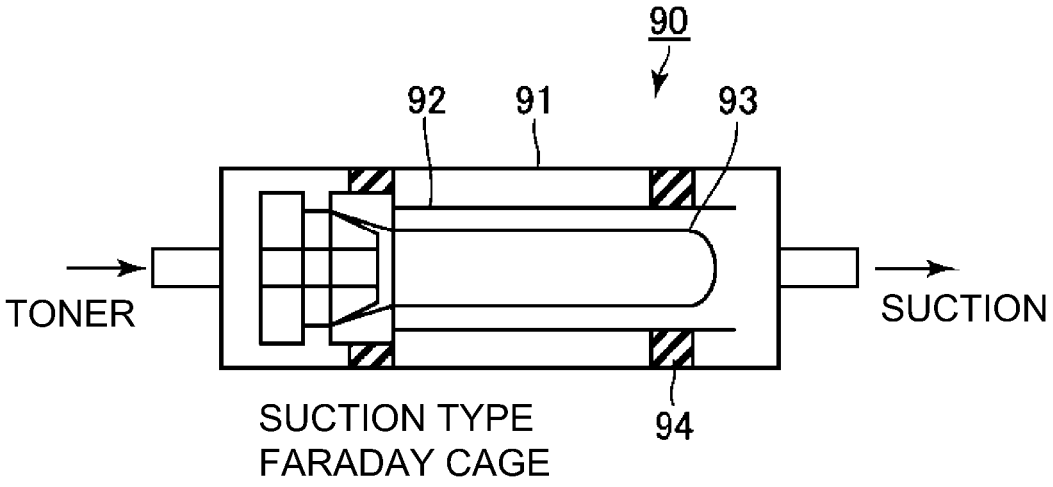
FIG. 24 is a schematic view of Faraday cage (cylinder).

The toner charge amount was measured using the Faraday-cage. FIG. 24 is an illustration of a structure of the Faraday-cage used for measuring the toner charge amount. The Faraday-cage includes a double cylinder in which metal cylinders different in shaft diameter are coaxially provided, and includes a toner collecting filter paper (filter) 93, for containing the toner, provided inside the double cylinder. An inner cylinder 92 and an outer cylinder 91 of the double cylinder are insulated by an insulating member 94, and when charged particles with a charge amount q are placed in the inner cylinder 92, its behavior is similar to that just like the existence of a metal cylinder with the charge amount 1 through electrostatic induction. The amount of charges induced in the double cylinder was measured by a measuring device ("KEITHLEY 616 DIGITAL ELECTROMETER"), and a value obtained by dividing the measured charge amount by a toner weight in the inner cylinder was used as a toner charge amount Q/M.

7. Supply Control

The two-component development type has advantages, such as image quality stability and durability of the apparatus, compared with other development types. On the other hand, in the two-component development type, the toner is consumed, whereby a TD ratio of the developer changes. As a result, a developing characteristic is changed by a change in toner charge amount of the developer in the developing device, so that an image density of an output image changes in some instances. For that reason, in order to maintain the image density of the output image at a substantially certain level, it is desired that the TD ratio of the developer or the image density is detected and the toner is supplied to the developing device with no excess and no deficiency. As described above, conventionally, as supply control, the inductance control type, the patch detection ATR control type, the video count control type and the triple control type have been known.

In the case where the video count control type is used alone, the TD ratio is deviated from a target value in some instances due to a fluctuation in supply amount when the supplying developer is actually supplied, a variation (difference among individuals) in supplying power of the supplying device, or the like. Further, in the case where the patch detection ATR control type is used alone, in order to suppress a fluctuation in image density of the output image, there is a need to execute the patch detection ATR control at a relatively high frequency, so that a lowering in productivity and an increase in toner consumption can be problematic.

In this respect, by automatically using a triple control type, that is, by using the above-described three control types in combination, the image density of the output image can be stabilized with a good balance. That is, in the case where the inductance control type is used alone, for example, when the toner charge amount is large, the TD ratio lowers more than expected in some instances due to a delay of detection by a difference in time until the developer lowered in TD ratio reaches a detecting position of an inductance detecting means. Accordingly, it is preferable from the viewpoint of an improvement in accuracy of TD ratio adjustment that an approximate toner charge amount is acquired on the basis of video count information and the supply amount of the supplying developer is corrected on the basis of inductance information. Further, even at the same TD ratio, a charging performance of the carrier gradually lowers in some instances due to deposition or the like of the toner on the surface of the carrier. Accordingly, it is preferable that the patch detection ATR control is executed at the relatively low frequency and a target TD ratio of the inductance control is changed.

In the triple control type, even in the case where the toner charge amount is large or the charging performance of the carrier changes, the image density of the output image can be stabilized while relatively lowering an execution frequency of the patch detection ATR control (while making an execution interval relatively long). Specifically, in the triple control type, the target TD ratio of the inductance control is changed depending on the image density of the patch image detected in the patch detection ATR control executed at the relatively low frequency. Further, the supply amount of the supplying developer necessary to adjust the detected TD ratio of the developer in the developing device to the changed target TD ratio is calculated. Then, to the calculated supply amount, a toner consumption amount estimated from the video count value is added, so that an actual supply amount of the supplying developer is calculated.

Also in this embodiment, the triple control type is employed as the supply control. That is, the following first, second and third control means are combined. Incidentally, the supply control is substantially the same for each of the four colors of yellow, magenta, cyan and black, and therefore, description will be made by paving attention to only one color.

First Control Means (Inductance Control Type):

This control is control such that the supply amount of the supplying developer is set so that the TD ratio detected by the toner content sensor 10 provided in the image forming apparatus 100 is maintained at the substantially same level (toner content control). As shown in FIG. 2, the developing device 4 is provided with the toner content sensor 10 as a toner content detecting means (TD ratio detecting means) for detecting the TD ratio of the developer in the detecting device. The toner content sensor 10 is disposed on a wall surface of the stirring chamber **40*b* in a side upstream of the developer supplying opening 45 with respect to the feeding direction of the developer in the stirring chamber 40*b*. The toner content sensor 10 outputs a signal depending on the TD ratio of the developer circulating in the developing container 40 and inputs the signal into the printer controller 15. In this embodiment, as the toner content sensor 10, an inductance sensor (permeability sensor) for detecting the TD ratio by detecting a change apparent permeability of the developer lowered by an increase in TD ratio is used. The output of the toner content sensor 10 lowers with a relative decrease in carrier by an increase in TD ratio and increases with a relative increase in carrier by a lowering in toner density ratio. The supply controller (supply control circuit) 34 of the printer controller 15 compares the TD ratio (toner content detection signal) of the developer in the developing container 40 detected by the toner content sensor 10 with the target TD ratio (toner content reference signal), and supplies the supplying developer on the basis of a comparison result. That is, the supply controller 34 controls an operation of the supplying device 50 so that the TD ratio detected by the toner content sensor 10 converges to the target TD ratio. The target TD ratio refers to an initial target TD ratio (initial toner content reference signal) stored in the ROM 18 in advance at an initial stage (before change of the TD ratio), and after the change of the TD ratio refers to a target TD ratio after the changed TD ratio is set by the patch detection ATR control and is stored in the ROM 18**.

Second Control Means (Patch Detection ATR Control Type):

This control is control such that the supply amount of the supplying developer is set so that the patch image (reference toner) density image detected by the image density sensor 7 provided in the image forming apparatus 100 is maintained at the substantially same level (toner charge amount control). As shown in FIG. 2, the image forming apparatus 100 is provided with the image density sensor 7 as an image density detecting means (detecting means of the toner amount per unit area). In this embodiment, the image density sensor 7 detects the image density (toner amount per unit area) of an intermediary gradation patch image formed on the photosensitive drum 1 under a predetermined image forming condition, and outputs a density signal depending on the image density and then inputs the density signal into the printer controller 15. The supply controller 34 of the printer controller 15 compares the patch image density (image density detection signal) detected by the image density sensor 7 with a reference image density (image density reference signal) of the patch image stored in the ROM 18 in advance. Then, on the basis of a comparison result, the supply controller 34 changes the target Td ratio in the inductance control and causes the ROM 18 to store the changed target TD ratio. The image density sensor 7 is disposed so as to oppose the photosensitive drum 1 at a position downstream of the developing region and upstream of the primary transfer portion T1 with respect to the rotational direction of the photosensitive drum 1. In this embodiment, the image density sensor 7 is an optical sensor of a regular (specular) reflection type in which light from an LED as a light source of a projector portion is emitted toward the surface of the photosensitive drum 1 and regularly reflected light from the surface of the photosensitive drum 1 is detected by a light-receiving element of a light-receiving portion. When the amount of the toner on the surface of the photosensitive drum 1 increases, scattering reflected light increases and regularly reflected light decreases, and therefore an output surface of the image density sensor 7 depending on the toner amount per unit area of the patch image is obtained. The patch image is formed during non-image formation other than during formation of the output image to be transferred and outputted on the recording material P. As during the non-image formation, it is possible to cite a period between an image and a subsequent image during continuous image formation (image interval, sheet interval), periods of a pre-rotation operation and a pre-multi-rotation operation which are preparatory operations before the image formation, and a period of a post-rotation operation which is a post-operation (preparatory operation) after the image formation, and the like.

Third Control Means (Video Count Control Type):

This control is control such that the supply amount of the supplying developer is set correspondingly to the toner consumption amount, for each image formed on a single recording material P, detected by the video count processing circuit 11 provided in the printer controller 15 (consumption amount supply control). In this embodiment, an exposure signal (or a density signal of an image information signal for each pixel) of the image during the image formation is processed, so that the toner consumption amount for each image formed on the single recording material P is acquired. The video count processing circuit 11 is an example of a counting means for counting, on the basis of the image information, an index value (video count, print ratio) correlated with the toner consumption amount by the development.

8. Supply control of Comparison Example 1

Next, with reference to a flowchart of FIG. 5, supply control in Comparison Example 1 in which a process of changing an execution frequency of the patch detection ATR control (described later) is not incorporated will be described. Supply control in this embodiment (Embodiment 1), in which the process of changing the execution frequency of the patch detection ATR control is incorporated, will be described later.

When image formation is started (S101), the video count processing circuit 11 of the printer controller 15 calculates the video count value of the image during the image formation (S102). In Comparison Example 1 (ditto for this embodiment), the video count value is a value obtained by counting H-level, for each pixel, of an output signal obtained by subjecting an output of the image signal processing circuit 12 of the printer controller 15 to pulse width modulation by the pulse width modulating circuit 13. This value is integrated over an entirety of an image size (original paper size, recording material size), so that a video count value corresponding to a development dot number per image formed on the single recording material P is calculated. Further, the video count processing circuit 11 acquires a print ratio for each image formed on the single recording material P from the video count value. In Comparison Example 1 (ditto for this embodiment), the video count value in the case where a solid image (image of 100% in print ratio) is formed on entire one surface of an A4-sized recording material for one color is "512", and for example, the print ratio in the case where the video count value is "26" is acquired as 5% through ratio calculation. Incidentally, also the case where the value is subjected, in the form of the print ratio acquired from the video count value, to the processing is described by referring the value as the video count value in some instances for convenience of explanation.

Figure 6:
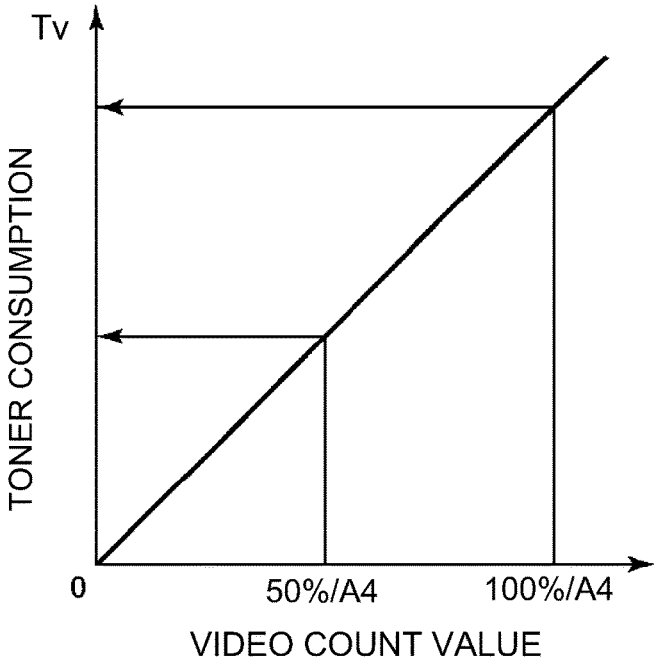
FIG. 6 is an illustration of a conversion table from a video count value into a toner consumption amount.

Then, the supplying controller 34 of the printer controller 15 calculates the toner consumption amount, i.e., a necessary toner supply amount F(Vc), from the video count value (hereinafter, this amount is referred to as a "video count control supply amount") by making reference to the conversion table of FIG. 6 (S103). In a conversion table of FIG. 6, the abscissa represents the video count value (print ratio) per image formed on the single recording material P, and the ordinate represents the video count control supply amount F(Vc). The conversion table of FIG. 6 is stored in the ROM 18 in advance.

Then, the supply controller 34 of the printer controller 15 acquires a toner density detection signal Vsig outputted through detection of the TD ratio of the developer in the developing device 4 by the toner density sensor 10 (S104).

Figure 7:
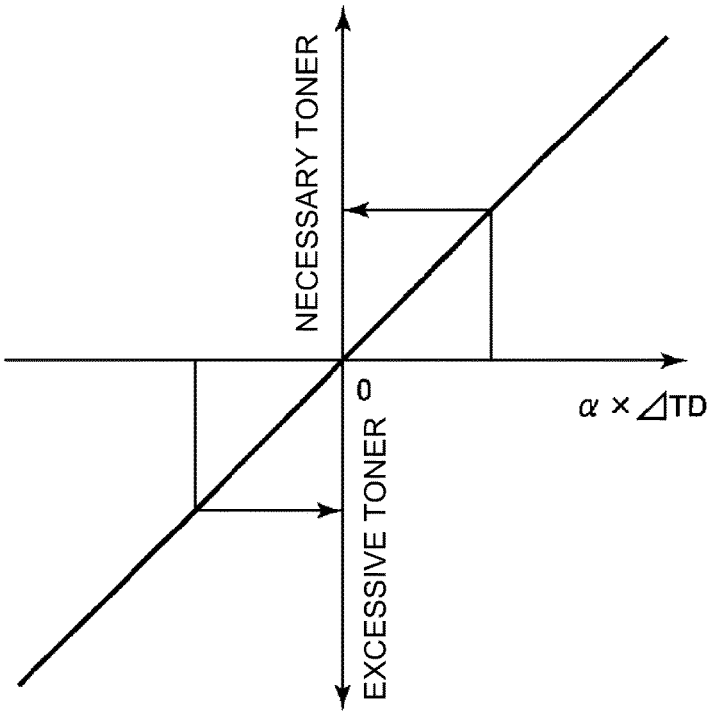
FIG. 7 is an illustration of a conversion table from a difference in TD ratio into a necessary toner supply amount.

Then, the supply controller 34 of the printer controller 15 compares a toner density reference signal Vtrg showing the target TD ratio stored in the ROM 18 with the acquired Vsig, and calculates a toner density difference ΔTD which is a difference between the target TD ratio and the actual TD ratio (S105). Specifically, in the case of $\Delta TD = Vtrg - Vsig < 0$, the supply controller 34 discriminates that the actual TD ratio is lower than the target TD ratio. Then, the supply controller 34 calculates a necessary toner supply amount F(TD) (hereinafter, referred to as an "inductance control supply amount") from the toner density difference ΔTD by making reference to the conversion table of FIG. 7. On the other hand, in the case of ΔTD=Vtrg−Vsig≥0, the supply controller 34 discriminates that the actual TD ratio is higher than the target TD ratio. Then, the supply controller 34 calculates the inductance control supply amount (excessive toner amount) F(TD) from the toner density difference ΔTD by making reference to the conversion table of FIG. 7. In the conversion table of FIG. 7, the abscissa represents a value (represented by a formula below) obtained by multiplying the toner density difference ΔTD by a TD relative sensitivity adjusting factor α, and the ordinate represents a necessary toner supply amount with respect to a positive direction and an excessive toner amount with respect to a negative direction. The conversion table of FIG. 7 is stored in the ROM 18 in advance. Accordingly, in the case of ΔTD>0, the toner supply amount F(TD) is calculated as a negative (−) value.

$$F(TD)=\alpha\times\Delta TD=\alpha\times(Vtrg-Vsig)$$

Then, the supply controller 34 of the printer controller 15 determines a toner amount F to be actually supplied to the developing device 4 (hereinafter, this amount is also referred to as an "actual toner supply amount" by a formula below (S106). In the following formula, "F(REMAIN)" is an amount of the toner reversed without being supplied in the last supply control since the block supply type is employed (hereinafter, this amount is also referred to as a "reversed supply amount").

$$F=F(TD)+F(Vc)+F(\text{REMAIN})$$

Then, the supply controller 34 of the printer controller 15 calculates an integer block supply number B(C) showing a supply amount in current supply control and a remaining reserved supply amount F(REMAIN) by dividing the actual toner supply amount F by one block supply amount (S107).

$$B(C)=F/\text{one block supply amount (200 mg)}$$

In this formula, an integer part represents a current supply amount, and the reminder represents the reversed supply amount F(REMAIN).

Then, when B(C)>1 is satisfied, the supply controller 34 of the printer controller 15 executes the supply control by a corresponding block supply number (S108). The reversed supply amount F(REMAIN) which is less than the one block supply amount is carried over to subsequent timing of the supply control.

In Embodiment 1 (ditto for this embodiment), the patch detection ATR control is carried out at a predetermined frequency (predetermined print number interval) during continuous image formation, so that the target TD ratio (toner density reference signal Vtrg) is changed. In Comparison Example 1, the change in target TD ratio by the patch detection ATR control is carried out every 200 sheets of image formation (also simply referred to as "printing") with respect to A4-sized recording materials P fed in a long edge feeding manner. That is, the printer controller 15 increments a patch detection ATR counter CNT by one every printing of one sheet (S109). The patch detection ATR counter is realized using a storing region of the ROM 18. Then, the printer controller 15 compares the patch detection ATR counter CNT with a counter threshold CNTth for discriminating execution timing of the patch detection ATR control, and discriminates whether or not the execution timing has arrived (S110). The counter threshold CNTth is stored in the ROM 18 in advance. In Comparison Example 1, CNTth=200 is set. The supply controller 34 executes the patch detection ATR control when the execution timing has arrived (when the counter (value) is not less than the counter threshold) (Yes of S110), and causes the image forming apparatus to continue image formation when the execution timing has not arrived (when the counter is less than the counter threshold) (No of S110).

When the printer controller 15 discriminated that the execution timing of the patch detection ATR control arrived, the printer controller 15 causes the image forming apparatus to form an electrostatic image for a patch image having a certain area on the photosensitive drum 1 and causes the developing device to develop the electrostatic image into the patch image under application of a predetermined developing contrast voltage (S111). Then, the printer controller 15 acquires an image density detection signal SigD outputted through detection of the patch image by the image density sensor 7 (S112).

Then, the supply controller 34 of the printer controller 15 compares the acquired SigD with an image density reference signal SigDref stored in the ROM 18 in advance and calculates a toner density reference signal Vtrg showing a new target TD ratio, and then causes the ROM 18 to store the new target TD ratio (S113). Thereafter, the supply controller 34 resets the patch detection ATR counter CNT to zero (S114).

The calculation of the toner density reference signal Vtrg showing the target TD ratio will be further described. The supply controller calculates an image density difference DOD which is a difference between the image density detection signal SigD and the image density reference signal SigDref. In the case of ΔOD=SigD−SigDref≥0, the supply controller 34 discriminates that the image density of the patch image is low. In this case, there is a need to increase the image density by modifying the target toner density ratio in an increasing direction. Accordingly, the supply controller 34 calculates the toner density reference signal Vtrg necessary to return the image density to the reference image density by a formula below. In the following formula, correction is made by multiplying the image density difference ΔOD by a TD ratio sensitivity adjusting factor β.

$$Vtrg=Vtrg+\beta\times\Delta OD$$

On the other hand, in the case of ΔOD=SigD−SigDref<0, the supply controller 34 discriminates that the image density of the patch image is high. In this case, there is a need to lower the image density by modifying the target toner density ratio in a decreasing direction. Accordingly, the supply controller 34 calculates the toner density reference signal Vtrg necessary to return the image density to the reference image density by a formula below.

$$Vtrg=Vtrg+\beta\times\Delta OD$$

In order to prevent that the target TD ratio acquired by the patch detection ATR control reaches out of an allowable range of the toner density ratio as a system value, for example, an upper limit and a lower limit may also be set for the target TD ratio. In Comparison Example 1 (ditto for this embodiment), in the case where the supply controller 34 discriminated that the calculated target TD ratio is smaller than the lower limit stored in the ROM 18 in advance, the supply controller 34 sets the target TD ratio at the lower limit. The lower limit of the target TD ratio is acquired using, as an index, generation of an image defect (white void image or the like due to carrier deposition) generating in the case where the TD ratio is excessively low, and is set in Comparison Example 1 (ditto for this embodiment) at 6% with respect to the initial TD ratio of 8%. Similarly, in the case where the supply controller 34 discriminated that the calculated target TD ratio is larger than the upper limit stored in the ROM 18 in advance, the supply controller 34 sets the target TD ratio at the upper limit. The upper limit of the target TD ratio is acquired using, as an index, generation of an image defect (so-called fog or the like such that the toner image is formed on a white background portion) generating in the case where the TD ratio is excessively high, and is set in Comparison Example 1 (ditto for this embodiment) at 12% with respect to the initial TD ratio of 8%. Specifically, the toner density reference signal Vtrg is compared with VLlmt indicating the lower limit of the target TD ratio VHlmt indicating the upper limit of the target TD ratio, and in the case or Vtrg<VLlmt, Vtrg=VLlmt is set, and in the case of Vtrg>VHlmt, Vtrg=VHlmt is set.

In Comparison Example 1, by carrying out the supply control in the triple control type, in many cases, the image density of the output image can be stabilized with a good balance. However, as described above, in the case where the high print ratio images are continuously printed (formed) immediately after the low print ratio images are continuously printed, the image density of the output image fluctuates to not less than an allowable level in some instances.

Further, in the case where the low print ratio images are continuously printed, the number of times of replacement of the toner in the developing device 4 is small, and therefore, the toner and the carrier are excessively triboelectrically charged, so that there is a tendency that the toner charge amount increases. Accordingly, there is a tendency that the target TD ratio of the inductance control is set at a high value by the patch detection ATR control executed at a relatively low frequency. In this situation, in the case where continuous printing of the high print ratio image is carried out, the toner supply with the toner consumption in a large amount is executed at a high frequency, and therefore, contrary to the above, a stirring time of the toner and the carrier decreases, so that the toner charge amount abruptly decreases. In the case where the execution frequency of the patch detection ATR control is low with respect to the lowering speed of the toner charge amount, the change in target TD ratio of the inductance control cannot follow the low execution frequency, so that the toner charge amount continuously lowers, with the result that the increase in image density of the output image generates in some instances. That is, the setting of the target TD ratio is changed to setting of a high target TD ratio during continuous printing of the low print ratio image, and therefore, the lowering in toner charge amount during continuous printing of the high print ratio image is accelerated by a double factor including an insufficient stirring time of the toner and the carrier and the setting of the high target TD ratio.

In Comparison Example 1, the execution frequency of the patch detection ATR control is every 200 sheets of printing. For that reason, when the printing is switched from the continuous printing of the low print ratio image to the continuous printing of the high print ratio image, in the case where a difference in print ratio is large, the change in target TD ratio by the patch detection ATR control cannot follow the change in toner charge amount, so that the fluctuation in image density of the output image becomes conspicuous in some instances.

Figure 8:
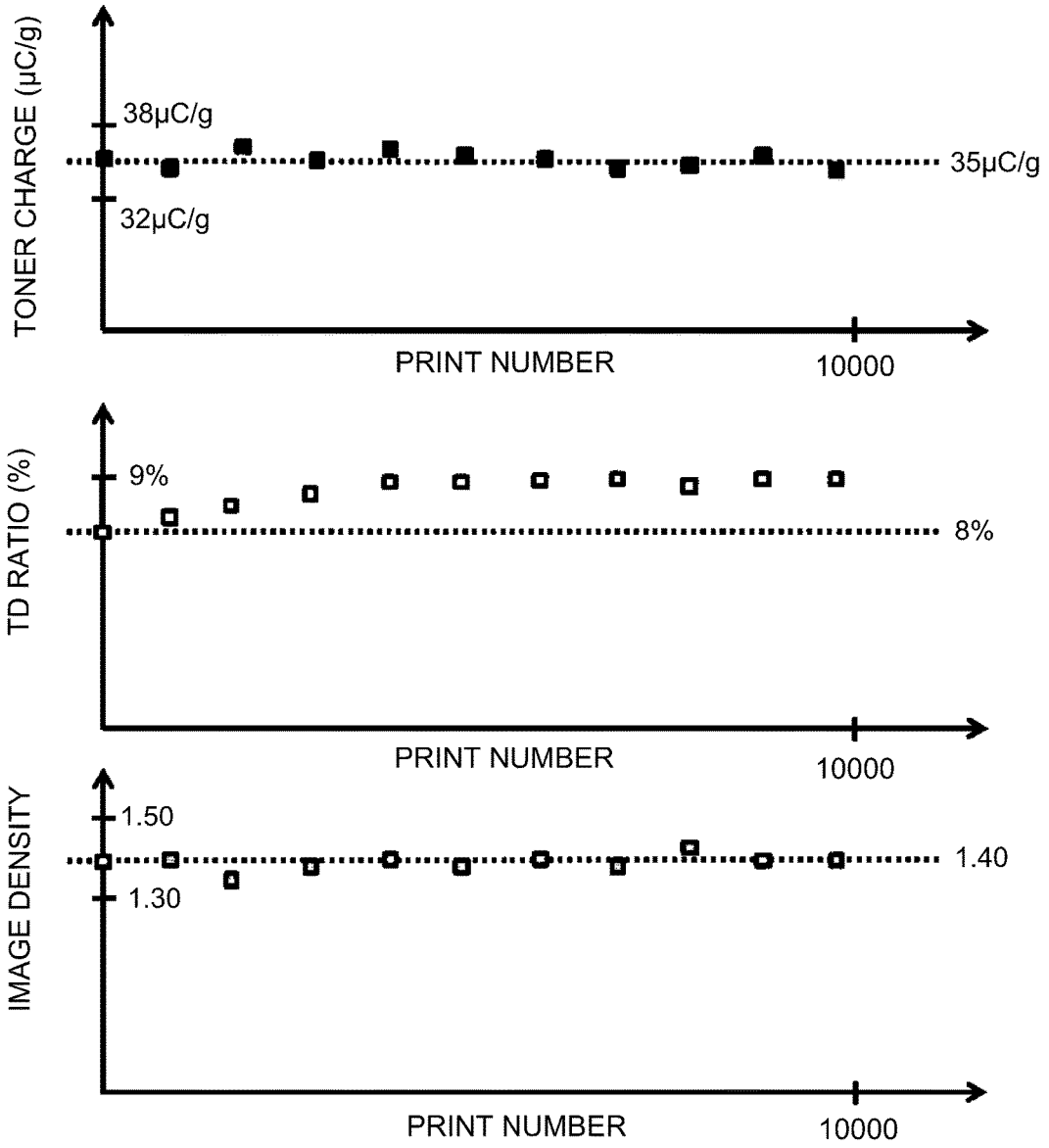
FIG. 8 is an illustration showing changes in toner charge amount, TD ratio and image density during printing of a low print ratio image in Comparison Example 1.
Figure 9:
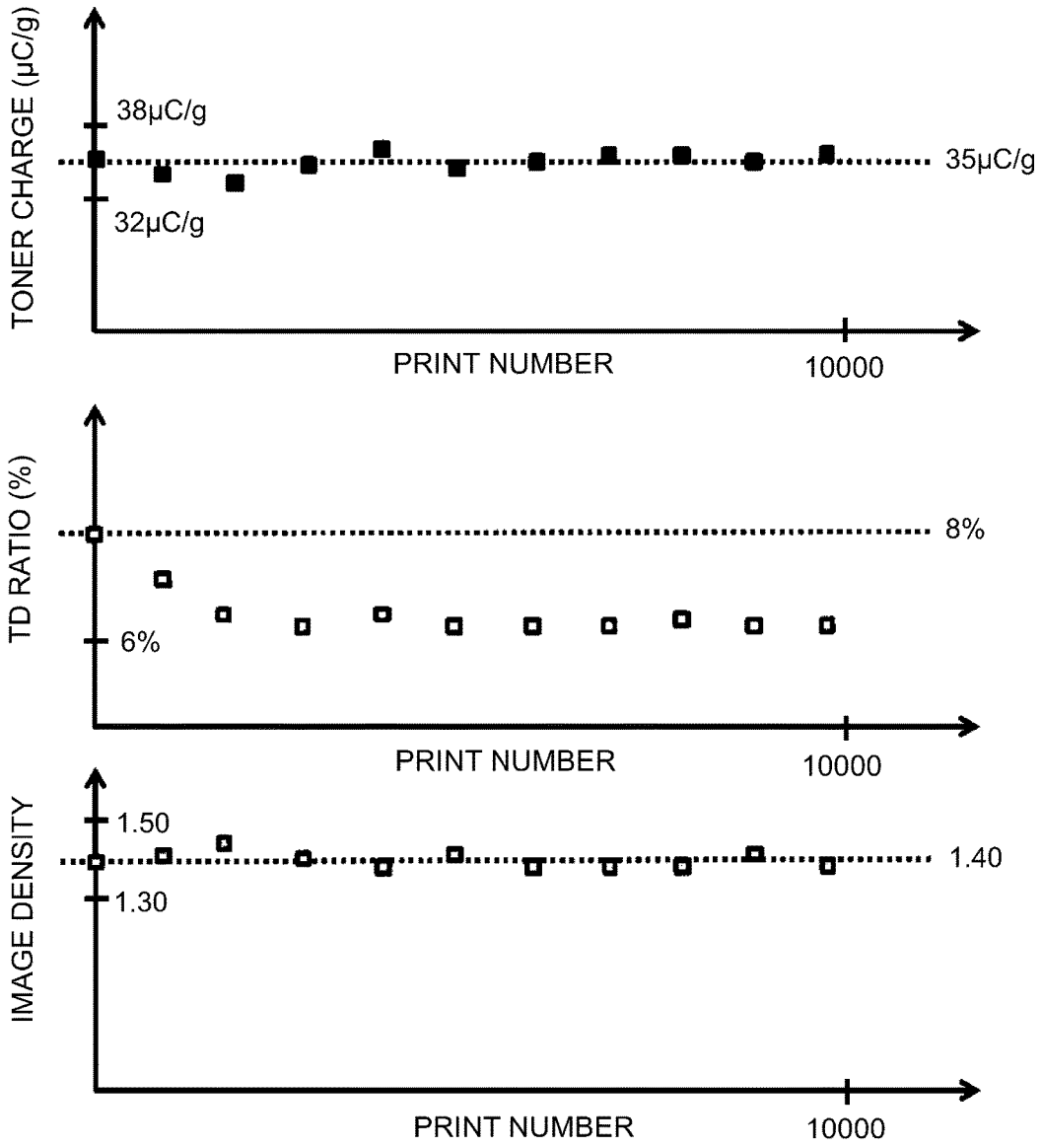
FIG. 9 is an illustration showing changes in toner charge amount, TD ratio and image density during printing of a high print ratio image in Comparison Example 1.

FIG. 8 includes graphs showing changes in toner charge amount, TD ratio and image density of the output image in Comparison Example 1 in the case where a 1%-print ratio image is printed on 10000 sheets from an initial stage. FIG. 9 includes graphs, similar to those of FIG. 8, in Comparison Example 1 in the case where a 30%-print ratio image is printed on 10000 sheets from the initial stage.

As shown in FIGS. 8 and 9, in either of cases of the print ratios of 1% and 30%, an initial toner charge amount is about 35 (μC/g). As described above, in the case of the 1%-print ratio image (FIG. 8), there is a tendency that the toner and the carrier are excessively charged due to less toner replacement in the developing device 4. However, the increase in toner charge amount is suppressed by increasing the target TD ratio by the patch detection ATR control, with the result that the toner charge amount can be made substantially constant in a range from 32 (μC/g) to 38 (μC/g). Further, as described above, in the case of the 30%-print ratio image (FIG. 9), there is a tendency that the stirring time of the toner and the carrier is shortened by execution of the toner supply at a high frequency with toner consumption in a large amount and thus the toner charge amount lowers. However, the decrease in toner charge amount is suppressed by decreasing the target TD ratio by the patch detection ATR control, with the result that the toner charge amount can be made substantially constant in a range from 32 (μC/g) to 38 (μC/g). Further, in either of cases of the print ratios 1% and 30%, the toner charge amount is controlled to a substantially certain level, and therefore, also the image density (optical density) of the output image is maintained at a substantially certain value of 1.40 as an initial value.

Figure 10:
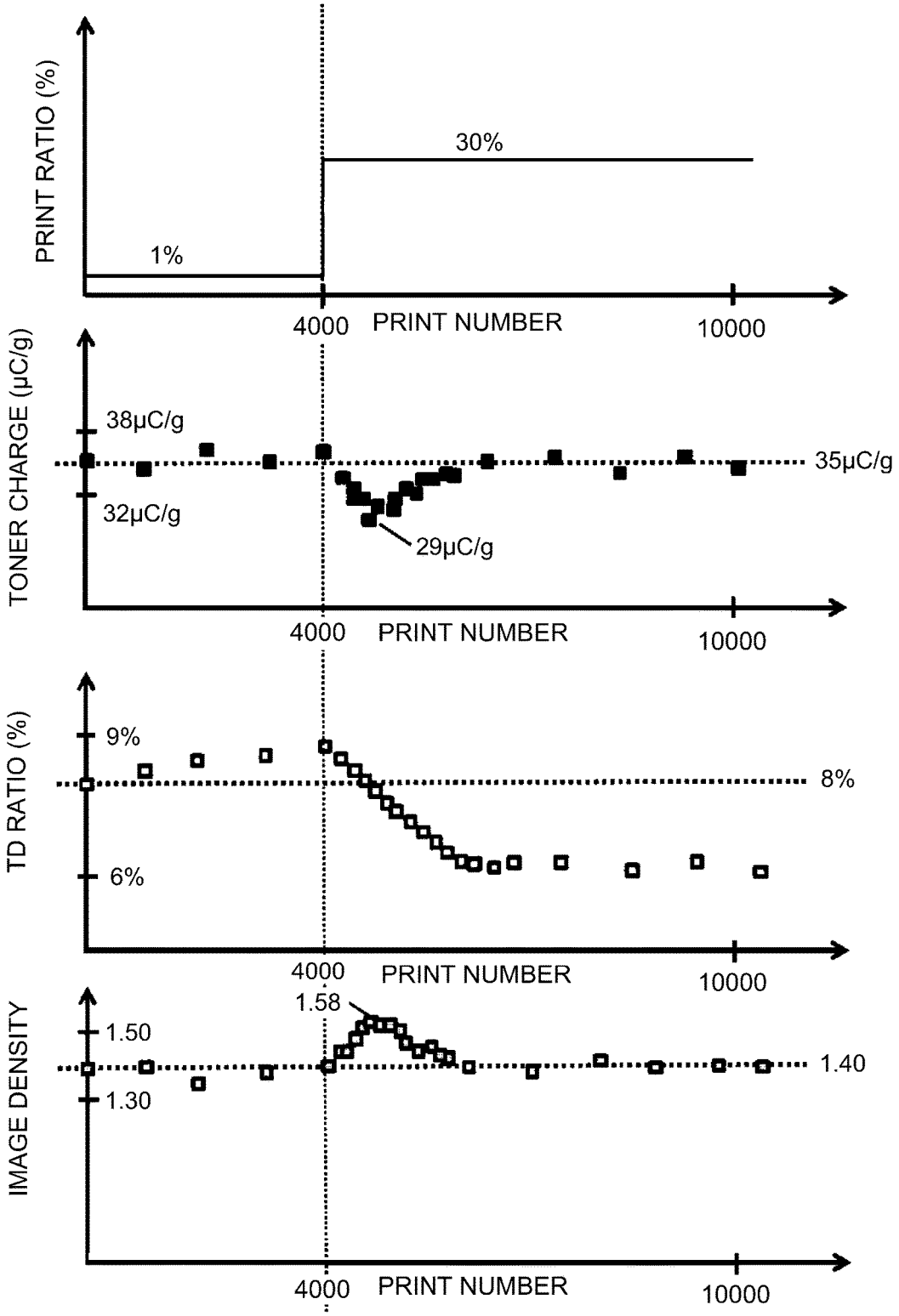
FIG. 10 is an illustration showing changes in print ratio, toner charge amount, TD ratio and image density in the case where printing is switched from the printing of the low print ratio image to the printing of the high print ratio image in Comparison Example 1.

On the other hand, FIG. 10 includes graphs showing changes in print ratio, toner charge amount, TD ratio and image density of the output image in Comparison Example 1 in the case where the 1%-print ratio image is printed from an initial stage (first sheet) to 4000-th sheets and the 30%-print ratio image is printed from 4001-th sheet to 10000-th sheet.

As shown in FIG. 10, from the first sheet to the 4000-th sheet in the printing of the 1%-print ratio image, similarly as in the case of FIG. 8, the toner charge amount can be suppressed by the increase in target TD ratio by the patch detection ATR control. Then, immediately after the print ratio is switched from 1% to 30% for the 4001-th sheet, the toner charge amount abruptly lowers. Then, the target TD ratio is lowered by the patch detection ATR control so as to suppress the lowering in toner charge amount, but the execution frequency of the patch detection ATR control is once per 200 sheets, and therefore, the execution of the patch detection ATR control cannot follow the lowering in toner charge amount, with the result that the toner charge amount temporarily lowers to 29 (μC/g). Thereafter, the target TD ratio is lowered by the patch detection ATR control, whereby the toner charge amount gradually increases and is finally substantially equal to the initial value, but during this period, the image density of the output image once increases to 1.58, with the result that a fluctuation in image density generates.

Thus, in Comparison Example 1, in the case where the fluctuation in predetermined ratio is large, the change in target TD ratio by the patch detection ATR control cannot follow the fluctuation in predetermined ratio, so that the fluctuation in image density of the output image generates in some instances. On the other hand, when the execution frequency of the patch detection ATR control is simply increased during the printing of the low print ratio image, a lowering in productivity and an increase in toner consumption amount are invited.

Incidentally, in FIGS. 8 to 10 (ditto for FIGS. 12, 20 and 23 described later), the numbers of data of the TD ratios and the like are not those of all data in the patch detection ATR control for convenience of representation, and the data are shown in a thinning-out manner.

9. Supply Control in Embodiment 1

Next, supply control in this embodiment (Embodiment 1) will be described. In this embodiment, roughly, the execution frequency of the patch detection ATR control is increased only when the printing is switched from the printing of the low print ratio image to the printing of the high print ratio image. As a result, the change in target TD ratio by the patch detection ATR control is caused to follow the change in toner charge amount, so that the fluctuation in image density of the output image is suppressed. On the other hand, in the case where the print ratio is constant and in the case where the printing is continued over a sufficient period after being switched from the printing of the low print ratio image to the printing of the high print ratio image, or in the like case, the change in toner charge amount is small, and therefore, the execution frequency of the patch detection ATR control is lowered (i.e., is returned to the execution frequency before being increased).

Thus, in this embodiment, the printer controller 15 controls the supply of the supplying developer so that the toner density detected by the toner density detecting means 10 approaches a target value. In addition, the printer controller 15 executes an adjusting operation (patch detection ATR control) for adjusting the target value on the basis of the image density of the reference toner image which is formed and detected by the image density detecting means 7. Then, the printer controller 15 changes timing when the adjusting operation is executed on the basis of information on a change amount of a counting result of the counting means 11 in a predetermined period. The printer controller 15 makes the execution frequency of the adjusting operation in the case where the change amount indicated by the information on the change amount is not less than a predetermined change amount, larger than that in the case where the change amount indicated by the information on the change amount is less than the predetermined change amount. As a result, only in a relationship in which the change in toner charge amount is large, the patch detection ATR control can be executed at a sufficiently high frequency, so that the lowering in productivity and the increase in toner consumption can be suppressed while suppressing the fluctuation in image density of the output image.

Figure 11:
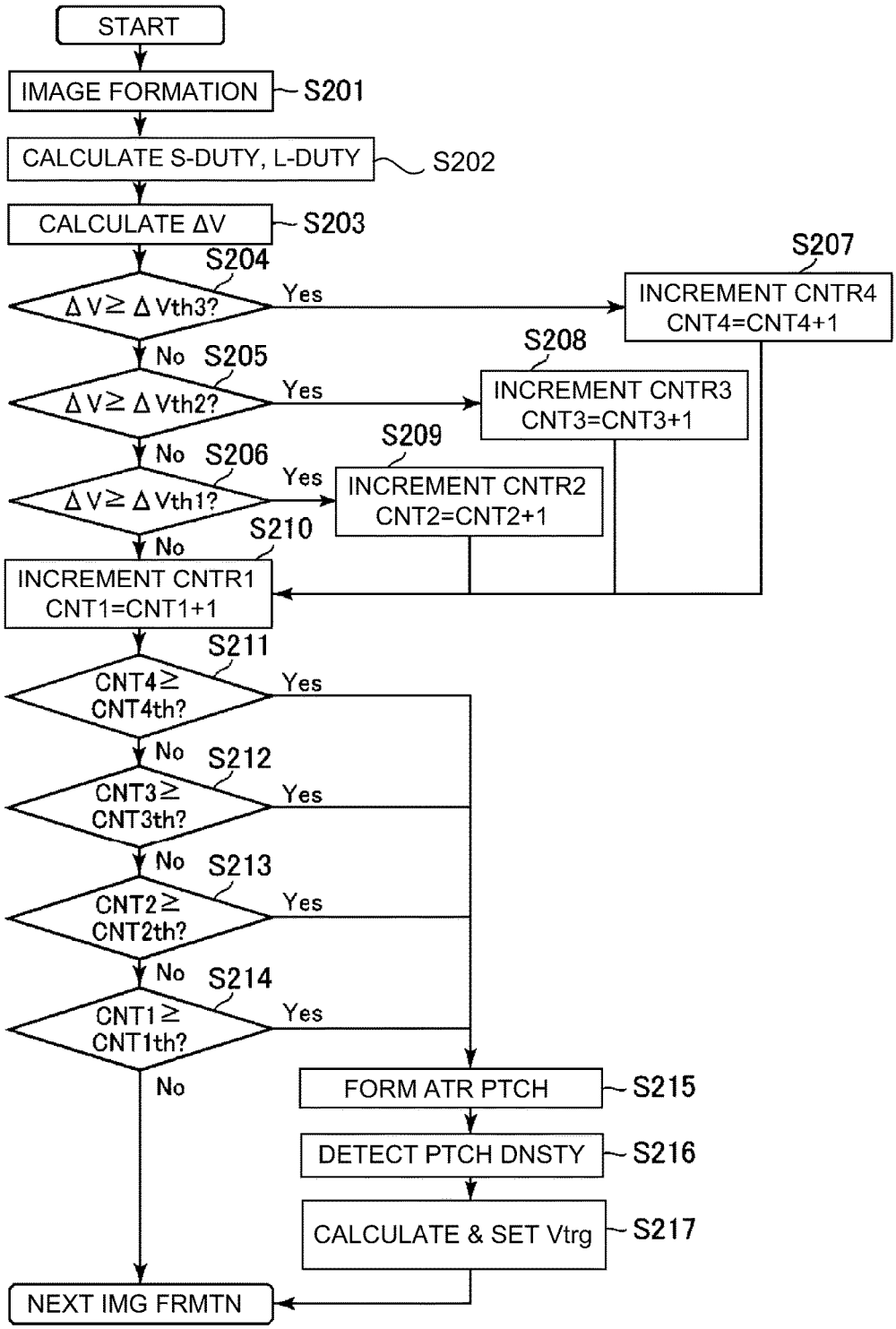
FIG. 11 is a flowchart of supply control in Embodiment 1.

FIG. 11 is a flowchart for illustrating the supply control in this embodiment. In order to avoid complicatedness, between S201 and S202 in FIG. 11, S102 to S108 in FIG. 5 in the above-described Comparison Example 1 are omitted from illustration.

Figure 5:
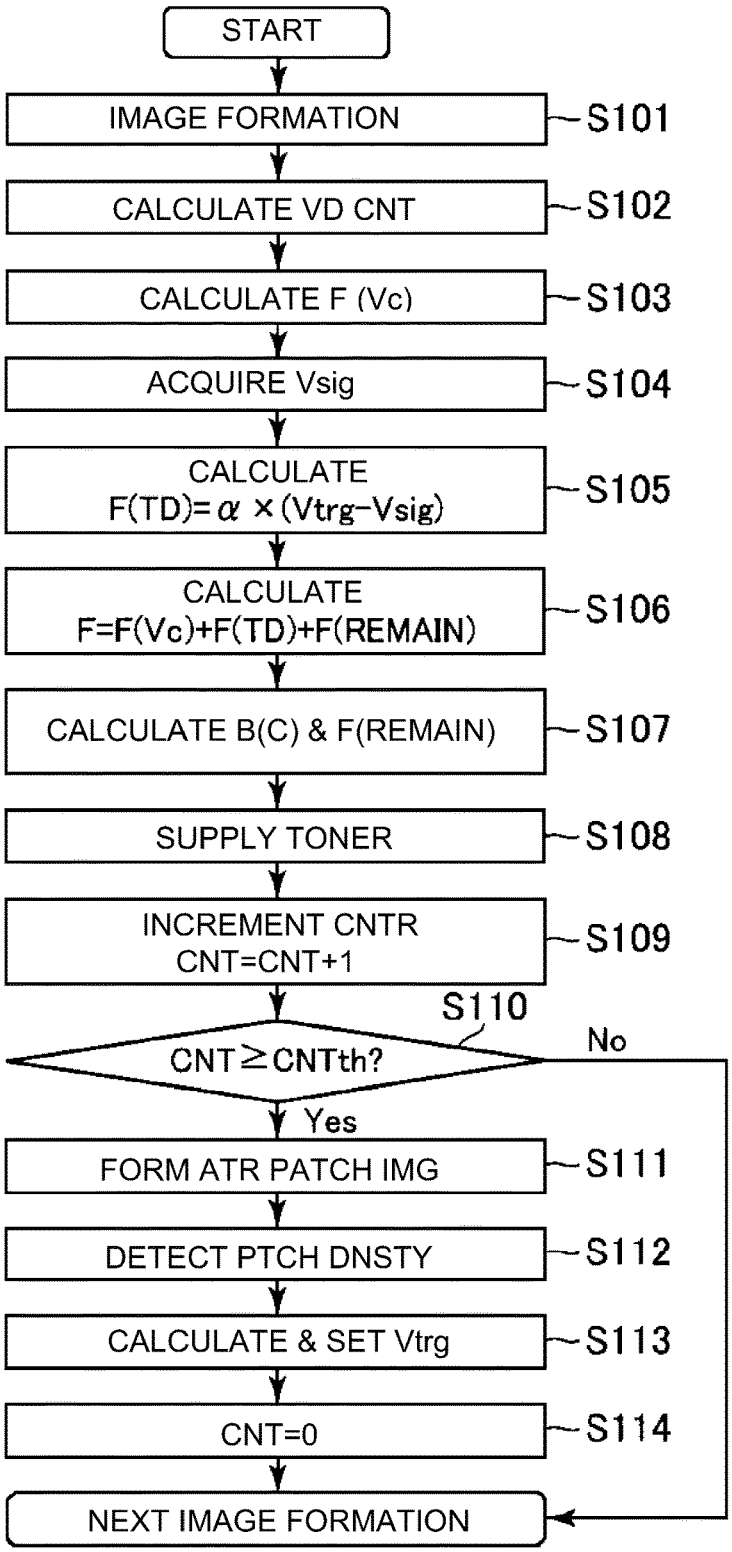
FIG. 5 is a flowchart of supply control in Comparison Example 1.

When image formation is started (S201), S102 to S108 in FIG. 5 are performed. At this time, when the print ratio is calculated from the video count value every printing of one sheet, the video count processing circuit 11 of the printer controller 15 successively renews a print ratio for 1000 sheets subjected to the last printing and causes the ROM 18 to store the renewed print ratio. The respective video count values for the 1000 sheets subjected to the last printing refer to V1 (first-sheet pre-print ratio), V2 (second-sheet pre-print ratio) . . . V1000 (1000-th-sheet pre-print ratio), respectively. Then, the supply controller 34 of the printer controller 15 averages the last print ratios V1 to V10 for each printing of one sheet, and thus calculates an average print ratio for 10 sheets subjected to the printing (hereinafter, this print ratio is referred to as an "S-DUTY") (S202). Further, the supply controller 34 of the printer controller 15 averages the last print ratios V1 to V1000 for each printing of one sheet, and thus calculates an average print ratio for 1000 sheets subjected to the printing (hereinafter, this print ratio is referred to as an "L-DUTY") (S202).

Then, the supply controller 34 of the printer controller 15 calculates, every printing of one sheet from the S-DUTY and the L-DUTY, a print ratio change rate (hereinafter, simply referred to as a "change rate") ΔV in accordance with the following ratio calculation (S203).

$$\Delta V = S\text{-DUTY}/L\text{-DUTY}$$

The case where the printing is switched from the continuous printing of the low print ratio image to the printing of the high print ratio image will be described. The change rate ΔV is calculated as a high value. In this way, by using the average print ratios of the print ratios in different two periods, it is possible to acquire a change in average print ratio. That is, the average print ratio in each of a first period and a second period, which are before this point of time and which are different from each other, are used. Then, the average print ratio in the first period and the average print ratio in the second period are compared with each other, so that whether or not there is a change in average print ratio by a certain value or more in a predetermined period prior to this point of time is discriminated. In this embodiment, the average print ratio in each of the first period from a first time which is prior to a reference time prior to this point of time to the reference time and the second period from a second time prior to the first time to the reference time is acquired. Then, from a ratio of the average print ratio in the first period to the average print ratio in the second period, whether or not there is a change in average print ratio by the certain value or more in the first period as the above-described predetermined period is discriminated. In this case, the first period and the second period can be appropriately set so that the change in average print ratio in the above-described predetermined period can be grasped to the extent that there is a need to increase the execution frequency of the patch detection ATR control in order to maintain the toner charge amount of the developer in the developing device 4 at a substantially certain value. Typically, the first period and the second period are set, as an index, at a unit of execution of the inductance control (toner density control), for example, at a print number in this embodiment. Further, typically, the reference time is the last printing time, the first time is the time prior to the last printing time by a first sheet number, and the second time is the time prior to the last printing time by a second sheet number larger than the first sheet number. However, the reference time is not limited to the last printing time, but may also be the printing time period to the last printing time. For example, due to a time or the like required to perform a calculating process, the reference time may also be the printing time prior to the last printing time by one sheet. Further, in this embodiment, the first period and the second period are the period from the first time prior to this point of time to this point of time and the period from the second time prior to this point of time to this point of time, respectively, and include an overlapping period therebetween, but may also be periods between which there is no overlapping period. Further, in this embodiment, the first and second periods are difference different unit lengths of periods, but may also have the same unit length of period. For example, from a ratio of the average print ratio in the first period from the printing time prior to the current printing time by 10 sheets to the current printing time, to the average print ratio in the second period from the printing time period to the current printing time by 20 sheets to the printing time prior to the current printing time by 11 sheets, whether or not there is a change in average print ratio by a certain value in the first period may also be discriminated.

Also in this case, the first period and the second period can be appropriately set similarly as described above.

In this embodiment, as a method of acquiring the change in average print ratio, the ratio between the average print ratios in different two periods is acquired, but the method is not limited thereto. For example, as the method of acquiring the change in average print ratio, a difference between the average print ratios in the different two periods may also be acquired. For example, whether or not there is a change in average print ratio by a certain value in the first period may also be discriminated from a difference between the average print ratio in the second period from the printing time prior to the current printing time by 20 sheets to the printing time prior to the current printing time by 11 sheets, and the average print ratio in the first period from the printing time prior to the current printing time by 10 sheets to the current printing time. Also in this case, between the first and second periods, the overlapping period may be present or absent, and the first and second periods may have different unit lengths or the same unit length and may also be appropriately set similarly as described above. Thus, the printer controller 15 compares averages of counting results of the counting means 11 in the different two periods, and acquires information on the above-described Comparison Example amount. At this time, the information on the change amount can be acquired on the basis of a ratio or a difference between the averages of the counting results of the counting means 11 in the different two periods.

Then, in this embodiment, on the basis of the change rate ΔV calculated for each printing of one sheet, the execution frequency of the patch detection ATR control is determined (S204 to S217). In this embodiment, depending on the change rate ΔV, the execution frequency of the patch detection ATR control is set. In this embodiment, roughly, the execution frequency is set every printing of 200 sheets in the case of $0 \leq \Delta V < 5$, every printing of 50 sheets in the case of $5 \leq \Delta V < 10$, every printing of 20 sheets in the case of $10 \leq \Delta V < 15$, and every printing of 10 sheets in the case of $15 \leq \Delta V$. In this embodiment, a plurality of print ratio change rate thresholds (hereinafter, also referred to as "change rate threshold(s)") compared with the change rate ΔV for use in the above-described control are set. Particularly, in this embodiment, as the change rate thresholds ΔVth, first, second and third change rate thresholds ΔVth1, ΔVth1 and ΔVth3 are set. Values and a relationship of these change rate thresholds ΔVth are set to satisfy: $\Delta Vth1=5<\Delta Vth2=10<\Delta Vth3=15$. The change rate thresholds ΔVth are stored in the ROM 18 in advance. In this embodiment, a plurality of patch detection ATR counters are provided. Particularly, in this embodiment, as the patch detection ATR counters, first, second, third and fourth counters CNT1, CNT2, CNT3 and CNT4 are provided. Further, in this embodiment, as counter thresholds CNTth, first, second, third and fourth counter thresholds CNT1th, CNT2th, CNT3th and CNT4th compared with the first, second, third and fourth counters (counter values), respectively, are set. In this embodiment, CNT1th=200, CNT2th=50, CNT3th=20 and CNT4th=10 are set. In the following, S204 to S217 will be specifically described.

First, the supply controller 34 of the printer controller 15 compares the change rate ΔV calculated in S203 with the largest third change rate threshold ΔVth3 of the plurality of change rate thresholds ΔVth (S204). In the case where ΔV is larger than ΔVth3, the supply controller 34 increments the fourth counter CNT4 by one (S207), and in the case where ΔV is smaller than ΔVth3, the supply controller 34 compares ΔV with the second change rate threshold ΔVth2 which has the second largest value (S205). In the case where ΔV is larger than ΔVth2, the supply controller 34 increments the third counter CNT3 by one (S208), and in the case where ΔV is smaller than ΔVth2, the supply controller 34 compares ΔV with the first change rate threshold Vth1 which has the smallest value (S206). Then, the supply controller 34 increments the second counter CNT2 by one (S209), in the case where ΔV is larger than ΔVth1, the supply controller 34 increments the second counter CNT2 by one (S209), and in the case where ΔV is smaller than ΔTh1, the supply controller 34 increments the first counter CNT1 by one (S210). The process of S210 is similarly carried out in all of the cases where the sequence goes to S207, S208 and S209.

Thereafter, the supply controller 34 of the printer controller 15 compares the first to fourth counters CNT1, CNT2, CNT3 and CNT4 with the first to fourth counter thresholds CNT1th, CNT2th, CNT3th and CNT4th, respectively (S211-S214). In this case, the counters are compared with the counter thresholds in an order from the fourth counter threshold CNT4th for which the counter is incremented by one when the change rate ΔV is larger than the fourth counter threshold CNT4th to the first counter threshold CNT1th for which the counter is incremented by one when the change rate ΔV is smaller than the first counter threshold CNT1th. Then, the supply controller 34 executes the patch detection ATR control in the case where at least one of the first to fourth counters CNT1, CNT2, CNT3 and CNT4 is not less than the associated threshold (S215-S217), and causes the image forming apparatus to continue the image formation in the case where all of the counters are less than the counter thresholds.

Thus, in this embodiment, the counter is changed depending on the range of the change rate ΔV calculated every printing of one sheet and the count value of each counter is compared with the threshold corresponding to the counter, and when even one of the count values is not less than the associated threshold, the patch detection ATR control is carried out. As a result, even in the case where the change rate ΔV varies for each printing, compared with the case where the execution frequency of the patch detection ATR control is uniquely determined depending on the value of the change rate ΔV, the patch detection ATR control is carried out at a proper frequency with no excess and no deficiency. For example, the continuous printing is carried out in the range of $0 \leq \Delta V < 5$, only the first counter CNT1 is incremented by one, and the count value thereof is compared with the first counter threshold CNT1th=200. For that reason, the execution frequency of the patch detection ATR control is every printing of 200 sheets. For example, in the case where the continuous printing is carried out in the range of $15 \leq \Delta V$, the fourth counter CNT4 and the first counter CNT1 are incremented by one. Then, the count values of these counters are compared with the fourth counter threshold CNT4th=10 and the first counter threshold CNT1th=200. For that reason, the patch detection ATR control is every printing of 10 sheets in general.

Figure 12:
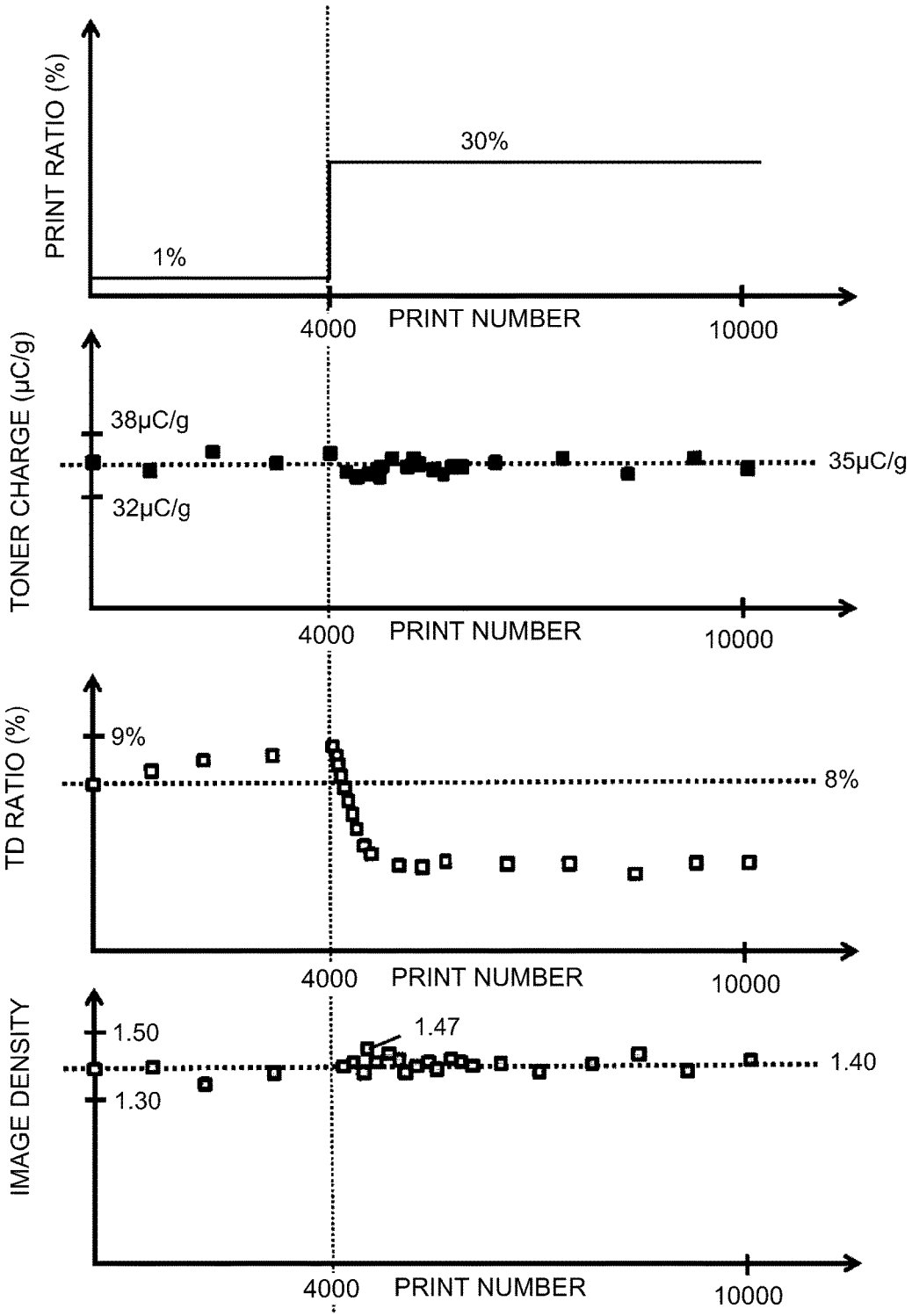
FIG. 12 is an illustration showing changes in print toner, toner charge amount, TD ratio and image density in the case where the printing is switched from the printing of the low print ratio image to the printing of the high print ratio image.
Figure 13:
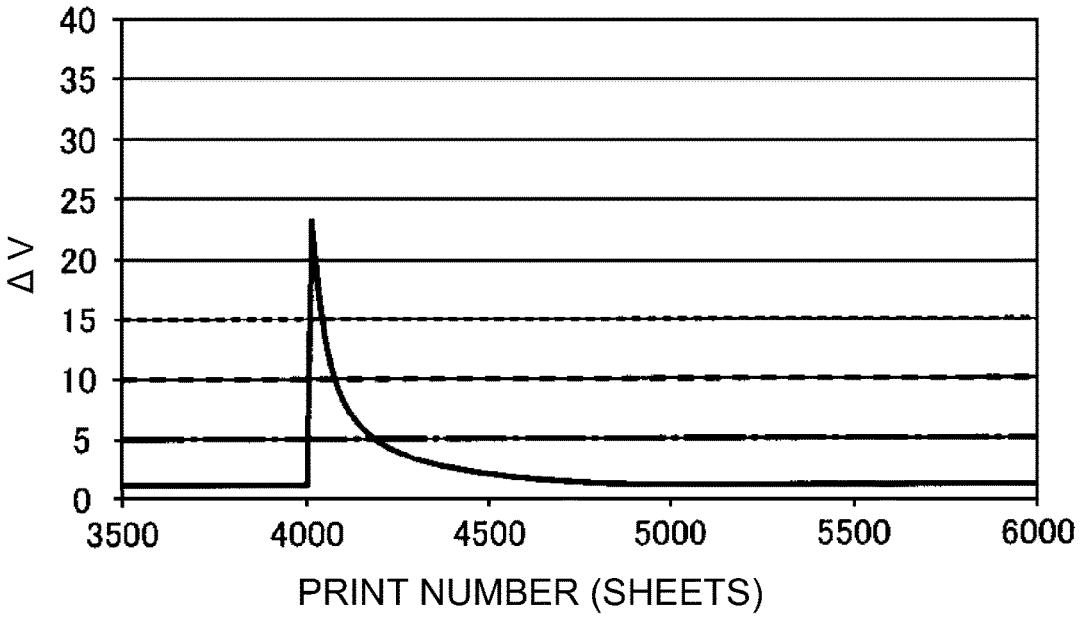
FIG. 13 is a graph showing a fluctuation of a print ratio change rate ΔV in an example of FIG. 12.

FIG. 12 includes graphs showing changes in print ratio, toner charge amount, TD ratio and image density of the output image in the case where printing of 1%-print ratio image is carried out from a first sheet (IT stage) to 4000-th sheet and then printing of 30%-print ratio image is carried out from 4001-th sheet to 10000-th sheet. FIG. 13 includes graphs showing a change in change rate ΔV in these cases from the first sheet to the 10000-th sheet.

As shown in FIG. 12, similarly as in the case of Comparison Example 1 (FIG. 10), as regards from the first sheet to the 4000-th sheet in the printing of the 1%-print ratio image, the increase in toner charge amount can be suppressed by an increase in target TD ratio through the patch detection ATR control. Thereafter, as shown in FIG. 13, the change rate ΔV abruptly increases immediately after the print ratio switches from 1% to 30% after 4000 sheets and exceeds the third change rate threshold Vth3=15, so that the patch detection ATR control is carried out at a high frequency of every printing of 10 sheets. As a result, as shown in FIG. 12, the target TD ratio is lowered quickly, so that the lowering in toner charge amount is suppressed. Thereafter, as shown in FIG. 13, the change rate ΔV moderately lowers and gradually converges to ΔV=1, and correspondingly, the execution frequency of the patch detection ATR control gradually lowers, so that the execution frequency of the patch detection ATR control is finally returned to the original value of every printing of 200 sheets.

Table 1 shows the number of times of execution of the patch detection ATR control in a period from a print number of 4001 sheets to a print number of 4500 sheets in each of Comparison Example 1 and this embodiment (Embodiment 1) in the case where the printing is switched from the printing of the 1%-print ratio image to the printing of the 30%-print ratio image after 4000 sheets.

TABLE 1

| | PDAEN[*1] |
|---|---|
| COMP. EX. 1 | 3 times |
| EMB. 1 | 8 times |

[*1]"PDAEN" is the patch detection ATR control execution number.

As shown in Table 1, in Comparison Example 1, the patch detection ATR control is carried out only three times, but on the other hand, in this embodiment, the patch detection ATR control is carried out eight times. As a result, in this embodiment, the target TD ratio can be quickly lowered compared with Comparison Example 1. For this reason, in Comparison Example 1, the image density of the output image increases to 1.58, so that a fluctuation in image density generates. On the other hand, in this embodiment, the image density of the output image is 1.47 at the maximum, so that the fluctuation in image density can be suppressed effectively.

Embodiment 2

Next, another embodiment of the present invention will be described. Basic constitutions and operations of an image forming apparatus in this embodiment are the same as those in Embodiment 1. Accordingly, in the image forming apparatus in this embodiment, elements having the same or corresponding functions and constitutions as those in the image forming apparatus in Embodiment 1 are represented by the same reference numerals or symbols and will be omitted from detailed description.

1. Summary of this Embodiment

In this embodiment, the change rate of the average print ratio was acquired, and the execution frequency of the patch detection ATR control was changed correspondingly to the change rate. However, in the case where the change rate ΔV is extremely large, the fluctuation in image density of the output image cannot be suppressed only by the control of the toner charge amount through the patch detection ATR control in some instances. Or, as a result of the patch detection ATR control, the target TD ratio reaches a lower limit, and thereafter, the fluctuation in image density of the output image cannot be suppressed in some cases.

In this embodiment, in the case where the change rate ΔV is not less than the threshold, not only the toner charge amount is changed by changing the execution frequency of the patch detection ATR control, but also the image density is changed by changing the execution frequency of control of correcting setting of the operation of forming the toner image on the photosensitive drum 1. That is, the printer controller 15 sets the execution frequency of each of an adjusting operation (patch detection ATR control) and another adjusting operation (density correction control) in the case where a change amount indicated by information on the above-described change amount (rate) is not less than a predetermined change amount in the following manner. That is, these execution frequencies are made larger than those of the adjusting operation and another adjusting operation in the case where the change amount indicated by the information on the change amount is less than the predetermined change amount.

In this embodiment, the correction of the setting (exposure amount of the exposure device 3 in this embodiment) of the operation of forming the toner image is made on the basis of a result of detection of the image density of a patch image, different from the patch image for the patch detection ATR control, by the image density sensor 7. As a result, even in the case where the print ratio abruptly changes, it becomes possible to effectively suppress the fluctuation in image density of the output image. Particularly in this embodiment, a predetermined patch image is formed at a predetermined frequency, and the exposure amount of the exposure device 3 is corrected on the basis of a detection result of the image density of the patch image, so that control (density correction control) in which an image density (maximum density Dmax) of a solid portion is made equal to a predetermined reference density is carried out. In this embodiment, the execution frequency of this density correction control is changed depending on the change rate ΔV, so that even in the case where the change rate ΔV is remarkably large and the fluctuation in image density of the output image cannot be completely suppressed only by the control of the toner charge amount through the patch detection ATR control, the fluctuation can be suppressed. Incidentally, separately from the patch image for the patch detection ATR control, the patch image for the density correction control is also referred to as a "density correction patch", and particularly, the density correction patch for correcting the maximum density Dmax is also referred to as a "maximum density patch (solid patch)".

2. Image Density Sensor

In this embodiment, the same image density sensor 7 is used in the patch detection ATR control and the density correction control. That is, in this embodiment, the image density detecting means is commonly used for detection of the image density of the patch image for the patch detection ATR control and detection of the image density of the patch image for the density correction control. Incidentally, image density sensors used in the patch detection ATR control and the density correction control may be separately provided.

The image density sensor 7 used in this embodiment will be described further specifically. In this embodiment, a reflected light quantity from the photosensitive drum 1 is measured by the image density sensor 7 at timing when the density correction patch (reference toner image) formed on the photosensitive drum 1 passes through a position (light irradiation position) below the image density sensor 7. A signal relating to this measurement result is inputted into the printer controller 15. The image density sensor 7 converts reflected light from the photosensitive drum 1 (infrared light in this embodiment) into an electric signal. An analog electric signal of 0-5 V outputted from the image density sensor 7 is converted into an 8-bit digital signal by an unshown A/D conversion circuit provided in the printer controller 15. Then, this digital signal is converted into density information by an unshown density converting circuit provided in the printer controller 15.

Figure 14:
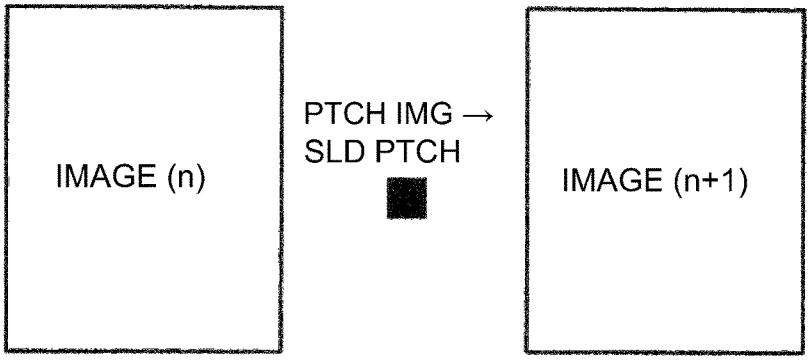
In FIG. 14, (a) and (b) are illustrations each showing a density correction patch.
Figure 14:
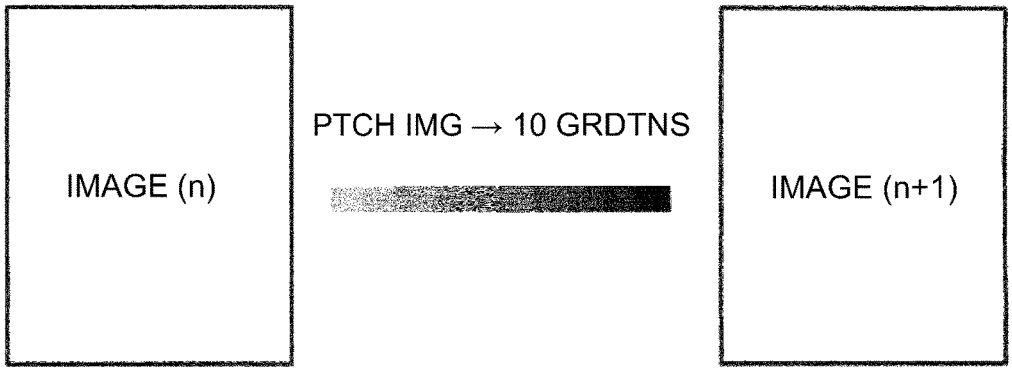

For example, as shown in (b) of FIG. 14, in the case where the image density of the density correction patch formed on the photosensitive drum 1 is stepwisely changed by area gradation, an output of the image density sensor 7 varies depending on the density of the image. In this embodiment, the output of the image density sensor 7 in a state in which the toner is not deposited on the photosensitive drum 1 is 5 V, and is read as 255 level of 0-255 levels by the above-described density converting circuit. The output of the image density sensor 7 becomes smaller with an increasing image density of the density correction patch (i.e., with a larger area coverage rate). In this embodiment, on the basis of a characteristic of the image density sensor 7, in the above-described density converting circuit, tables, exclusively used for the respective colors, for converting outputs from the image density sensor 7 into respective color image density signals are set in advance. These tables are stored in a storing portion of the density converting circuit. As a result, the density converting circuit is capable of reading the patch image density with accuracy. The density converting circuit outputs the density information to the CPU 16.

3. Density Correction Patch

The printer controller 15 causes the image forming apparatus to form the density correction patch (maximum density patch) as shown in (a) of FIG. 14 in an image interval (non-image region between a trailing end of an image and a leading end of a subsequent image) at a predetermined frequency (for each predetermined print number in this embodiment) during continuous printing. That is, the printer controller 15 controls the exposure device 3 to form an electrostatic patch image which is an electrostatic image for the density correction patch and causes the developing device 4 to develop the electrostatic patch image, so that the density correction patch is formed. The printer controller 15 causes the image forming apparatus to execute the density correction control (described later) so that the exposure amount of the exposure device 3 is corrected so that the image density (maximum density Dmax in this embodiment) of the density correction patch detected by the image density sensor 7 converges to the reference density.

The printer controller 15 includes a pattern generator (image signal generating circuit) 33 for generating a patch image signal of a signal level corresponding to a preset image density in order to form the density correction patch. The patch image signal from the pattern generator 33 is supplied to the pulse width modulating circuit 13, and the pulse width modulating circuit 13 generates a laser driving pulse having a pulse width corresponding to the above-described preset image density. This pattern generator 33 is also used for forming the patch image for the patch detection ATR control.

In this embodiment, an image signal value generated from the pattern generator 33 is determined through the gradation correction table (γ-LUT) corrected by gradation correction control executed in a later stage of automatic gradation correction control (described later). In this embodiment, the density correction patch is only a single maximum density patch (reference toner image with maximum density setting) as shown in (a) of FIG. 14. However, as described later, the density correction patch may also be constituted by a plurality of gradation patch images (a plurality of reference toner images with different density settings) including a maximum density patch as shown in (b) of FIG. 14.

4. Density Correction Control

Figure 15:
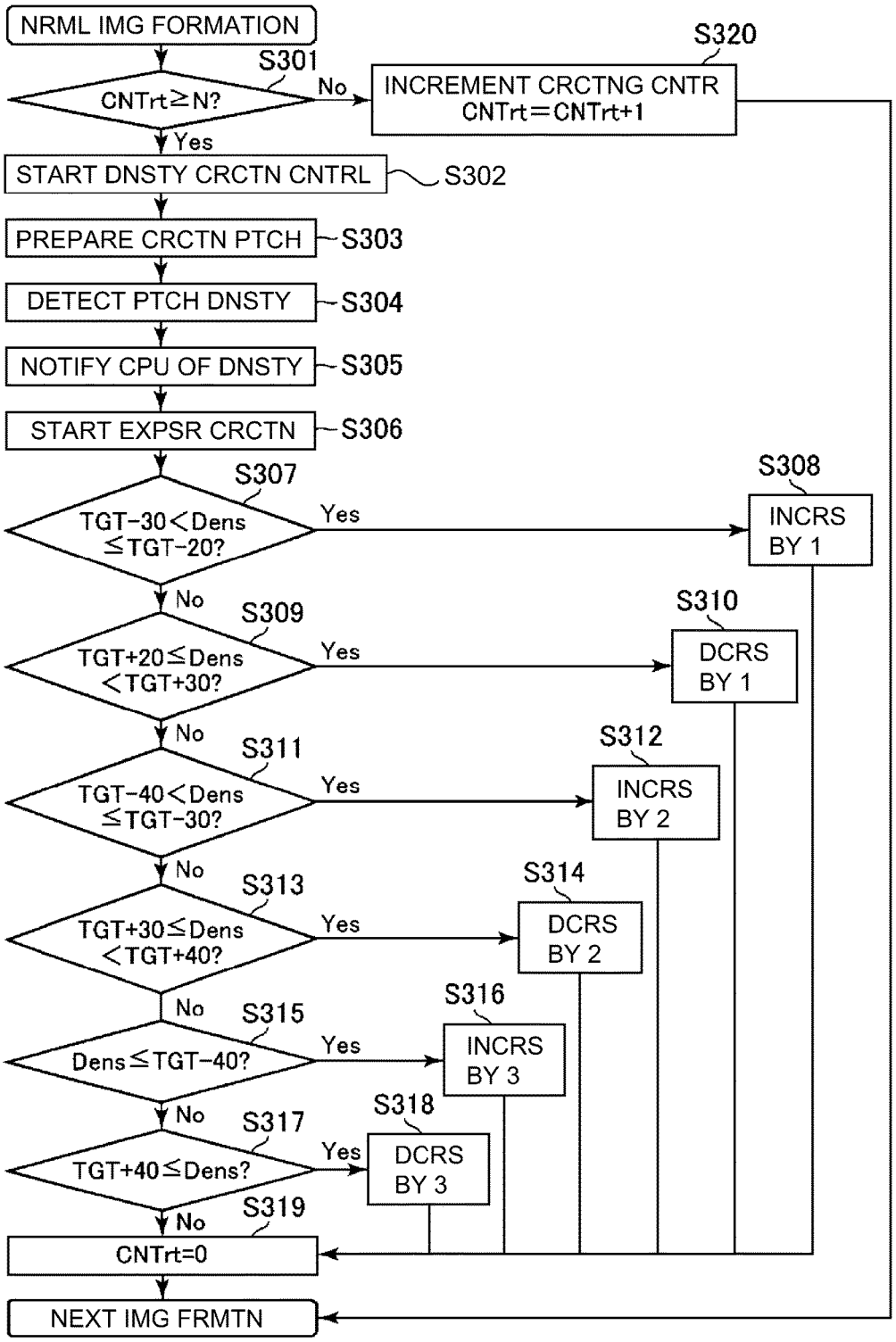
FIG. 15 is a flowchart of density correction control.

Next, with reference to a flowchart of FIG. 15, the density correction control in this embodiment will be described. Incidentally, the density correction control is substantially the same for the four colors of yellow, magenta, cyan and black, and therefore will be described by paying attention to one color.

First, the CPU 16 compares a density correction counter CNTrt with a density correction threshold N for each printing of one sheet (S301). In the case where the density correction counter CNTrt is less than the density correction threshold N, the CPU 16 increments the density correction counter CNTrt by one (S320). The density correction counter is realized using a storing region of the ROM 18. Further, the density correction threshold N is stored in the ROM 18 in advance. On the other hand, in the case where the density correction counter CNTrt is not less than the density correction threshold N, the CPU 16 executes the density correction control. That is, the CPU 16 causes the image forming apparatus to form the density correction patch (maximum density patch in this embodiment) on the photosensitive drum 1 (S303), and causes the image density sensor 7 to detect the image density of this density correction patch (S304). Then, the CPU 16 acquires information on the detected image density (hereinafter also referred to as a "detected density") of the density correction patch detected by the image density sensor 7 (S305). Thereafter, the CPU 16 compares the detected density with a preset target value of the image density (hereinafter also referred to as "density target" and executes control of correcting an exposure amount (light quantity of irradiation per unit area and unit time) (S306-S318). In this embodiment, the density target is acquired during the gradation correction control (described later) using the output image (toner image after being fixed on the recording material P) and is stored in the ROM 18. Then, the CPU 16 executes the density correction control and then resets the density correction counter CNTrt to zero (S319).

The correction of the exposure amount of the exposure device 3 in S306-S318 will be further described. In this embodiment, a difference between the image density (detected density) of the maximum density patch detected by the image density sensor 7 and the density target is acquired and is fed back to correct the exposure amount of the exposure device 3 so as to reduce the difference. As the density target, the maximum density Dmax is registered by the automatic gradation correction control (described later). The exposure amount of the exposure device 3 is obtained by subjecting a maximum output value of the exposure device 3 to 8-bit AD conversion, and is represented by a signal value from 0 to 255.

Table 2 shows a correction condition of the exposure amount in a direction such that a detected density Dens is lower than a density target TGT and the image density is made equal to the density target by increasing the exposure amount. That is, in this embodiment, in the case of Dens≤

(TGT−40), a change amount of the exposure amount during subsequent image formation and later (i.e., until subsequent density correction control is carried out) is +3. Similarly, the change amount is +2 in the case of (TGT−40)<Dens≤(TGT−30) and is +1 in the case of (TGT−30)<Dens≤(TGT−20).

TABLE 2

| Condition*1 | D ≤ T40 | T40 < D ≤ T30 | T30 < D ≤ T20 |
|---|---|---|---|
| CAOEA*2 | +3 | +2 | +1 |

*1"Condition" is the correction condition in which "D" is the detected density, "T40" is (TGT − 40), "T30" is (TGT − 30) and "T20" is "TGT − 20".
*2"CAOEA" is the change amount of the exposure amount.

Table 3 shows a correction condition of the exposure amount in a direction such that a detected density Dens is higher than a density target TGT and the image density is made equal to the density target by decreasing the exposure amount. That is, in this embodiment, in the case of (TGT+40)≤Dens, a change amount of the exposure amount during subsequent image formation and later (i.e., until subsequent density correction control is carried out) is −3. Similarly, the change amount is −2 in the case of (TGT+30)≤Dens<(TGT+40) and is +1 in the case of (TGT+20)≤Dens<(TGT+30).

TABLE 3

| Condition*1 | T20 ≤ TD < T30 | T30 < D ≤ T40 | T40 ≤ D |
|---|---|---|---|
| CAOEA*2 | −1 | −2 | −3 |

*1"Condition" is the correction condition in which "D" is the detected density, "T20" is (TGT + 20), "T30" is (TGT + 30) and "T40" is "TGT + 40".
*2"CAOEA" is the change amount of the exposure amount.

Figure 16:
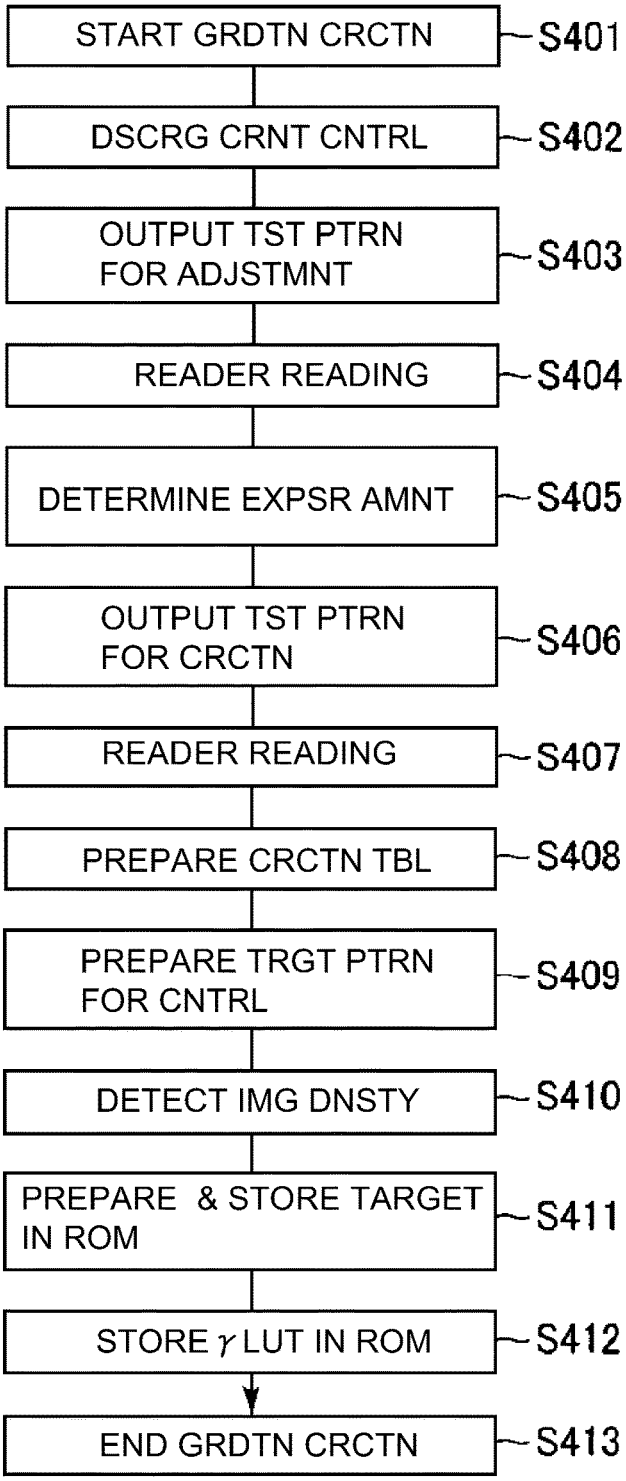
FIG. 16 is a flowchart of automatic gradation correction control.

Next, with reference to a flowchart of FIG. 16, the automatic gradation correction control will be described. The automatic gradation correction control is arbitrarily executed by an operator such as a user through the operating portion 200 (FIG. 2) of the image forming apparatus 100 or is automatically executed at preset timing.

Figure 17:
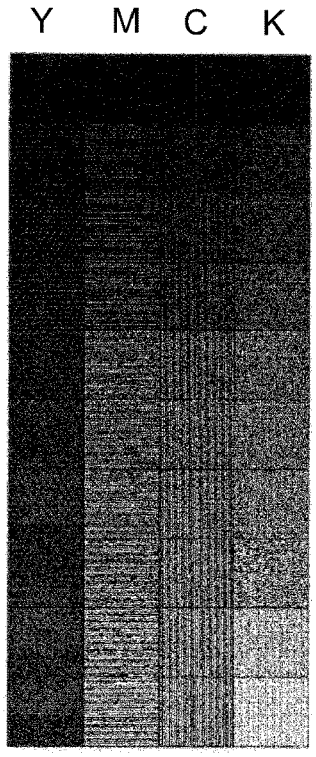
In FIG. 17, (a) and (b) are schematic views each showing a test pattern used in the automatic gradation correction control.
Figure 17:
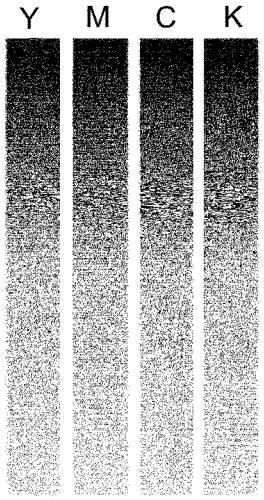
Figure 18:
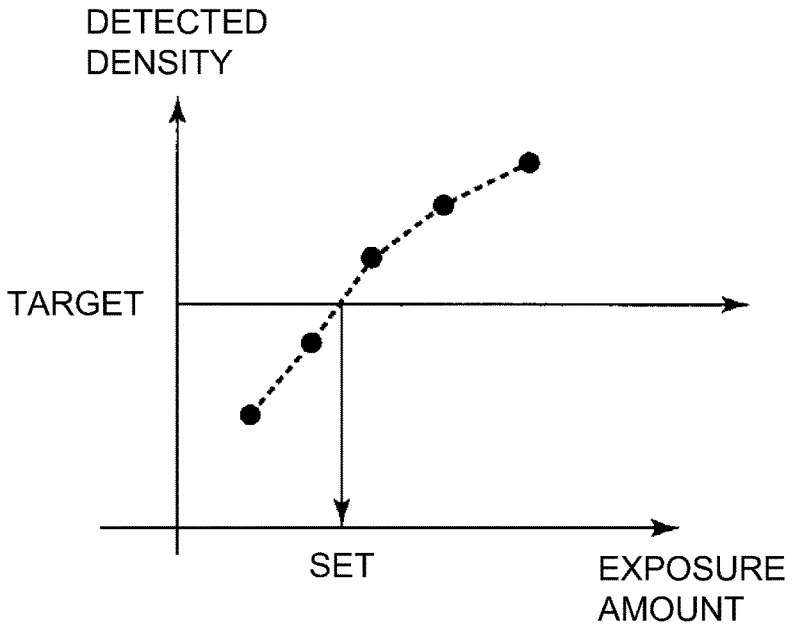
FIG. 18 is a graph for illustrating an adjusting method of an exposure amount (developing contrast potential) in the automatic gradation correction control.

When the automatic gradation correction control is started (S401), the CPU 16 adjusts the charging voltage and the transfer voltage (S402). Thereafter, the CPU 16 causes the image forming apparatus to form, on the recording material P, a test pattern constituted by maximum density (8 bit-FFh signal) images of the respective colors of yellow, magenta, cyan and black as shown in (a) of FIG. 17 and to output the test pattern (S403). This test pattern is formed by changing the exposure amount of the exposure device 3 for each of the respective maximum density color images into a plurality of levels. Next, the recording material P on which the above-described test pattern is formed is set in the original reading device 101 by the operator such as the user, and information on the test pattern is read by the original reading device 101 and is inputted into the CPU 16 (S404). Then, the CPU 16 determines the exposure amount of the exposure device 3 on the basis of the acquired density information (S405). That is, FIG. 18 is a plot of a relationship between the exposure amount and the detected density for each color test pattern, in which the abscissa represents the exposure amount and the ordinate represents the detected density. The CPU 16 acquires the relationship as shown in FIG. 18 and then acquires an exposure amount for obtaining a preset density target by calculation. Then, the CPU 16 causes the ROM 18 to store the acquired exposure amount and sets the exposure amount at a new exposure amount for the maximum density Dmax.

Next, the CPU 16 carries out half-tone gradation correction (γ-LUT correction) after determining the exposure amount. First, the CPU 16 causes the image forming apparatus to form, on the recording material P, a test pattern constituted by 64 gradation (fixed signal value selected from 8 bit-0 signal to 8 bit-FFh signal) images of the respective colors of yellow, magenta, cyan and black as shown in (b) of FIG. 17 and to output the test pattern (S406). Next, the recording material P on which the above-described test pattern is formed is set in the original reading device 101 by the operator such as the user, and information on the test pattern is read by the original reading device 101 and is inputted into the CPU 16 (S406). Then, the CPU 16 acquires an engine γ-characteristic in an entire density region on the basis of the acquired density information and prepares the gradation correction table (γ-LUT) which is a correction table for an input image signal from the engine γ-characteristic and a preset target gradation characteristic (hereinafter also referred to as a "gradation target") (S408).

When the above-described operation is ended, the image density of the image outputted onto the recording material P coincides with the gradation target in the entire density region. Accordingly, the density correction patch is formed on the photosensitive drum 1 under this condition and an image density thereof is detected by the image density sensor 7, so that the detected density is the density target of the image on the photosensitive drum 1 with respect to the input signal. In this embodiment, after the gradation correction table (γ-LUT) is prepared, the CPU 16 causes the image forming apparatus to form the maximum density patch as shown in (a) of FIG. 14 on the photosensitive drum 1 (S409) and causes the image density sensor 7 to detect the image density of the patch (S410). Then, the CPU 16 causes the ROM 18 to store a detection result as a density target of the maximum density Dmax (S411). Further, the CPU 16 causes the ROM to store the above-prepared gradation correction table (γ-LUT) as a reference LUT used in an LUT interpolation process carried out during the gradation correction (S412). Thereafter, the CPU 16 ends the automatic gradation correction control (S413).

6. Modified Embodiment of Density Correction Control

In this embodiment, as the density correction patch, the single maximum density patch is used, and therefore a single image density Dens is detected in the density correction control by the image density sensor 7. Further, in this embodiment, this image density Dens is compared with the density target of the maximum density Dmax, and then the exposure amount of the exposure device 3 is controlled. However, the density correction patch is constituted by a plurality of gradation patch images, and in addition to the above-described exposure amount control, the gradation correction control using the correction table (LUT) is carried out, so that also the half-tone density can be controlled. That is, in this embodiment, in the density correction control, the gradation correction using the correction table (LUT) is not made, but only the correction of the exposure amount of the exposure device 3 with respect to the maximum density is made. However, it becomes possible to grasp the engine γ-characteristic by constituting the density correction patch from the plurality of gradation images and by subjecting discrete density data corresponding to a plurality of gradation levels to linear interpolation.

Figure 19:
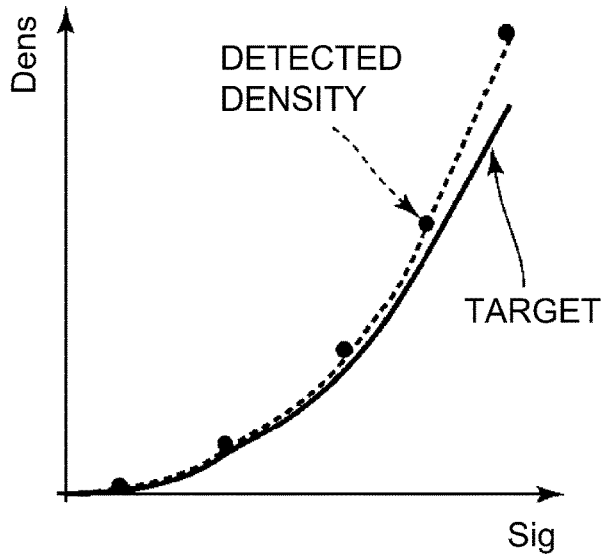
FIG. 19 is a graph for illustrating a method in which the density correction patch is detected and gradation correction is carried out.

FIG. 19 shows an engine γ-characteristic in the case where the density correction patch is a 5-gradation patch image including the maximum density patch. In the density correction control, after the engine γ-characteristic as shown in FIG. 19 is grasped, for each of the input signals, as described later, a reverse conversion process with respect to the density target (gradation target) prepared during the automatic gradation correction is carried out, so that the correction table (LUT) can be prepared. At this time, data actually used for preparing the correction table (LUT) is density data of the gradation patch images, of the density correction patch, other than the maximum density. The density data of the maximum density patch is used for correcting the above-described exposure amount. Further, during normal image formation, the image signal is determined through the correction table (LUT).

In the case where the density correction patch consisting of a plurality of gradation patch images is used in the density correction control, an operation of acquiring the density target (gradation target) in a layer stage of the automatic gradation correction control is as follows. After the gradation correction table (γ-LUT) is prepared, the CPU 16 causes the image forming apparatus to form the 10-gradation density correction patch (including the maximum density patch) for each color as shown in (b) of FIG. 14 on the photosensitive drum 1 (S409) and causes the image density sensor 7 to detect the image density of the patch (S410). Then, the CPU 16 causes the ROM 18 to store a detection result as the density target (gradation target) of the maximum density Dmax (S411).

Thus, the density correction control which is an adjusting operation other than the patch detection ATR control may be at least one of an operation of adjusting the exposure amount of the exposure device 3 by using the maximum image patch or an operation of correcting the density information in the image information by using the gradation patch image.

7. Change in Execution Frequency of Density Correction Control

Next, a density fluctuation of the output image in each of Comparison Example 2 in which the execution frequency of the density correction control is constant irrespective of the change rate ΔV and this embodiment (Embodiment 2) in which the execution frequency is changed depending on the change rate ΔV will be described. In Comparison Example 2, control substantially similar to the control in Embodiment 2 is carried out except that the execution frequency of the density correction control is different from that in Embodiment 2.

7-1. Comparison Example 2

In Comparison Example 2, the density correction threshold N is a constant of N=200. The density correction control (FIG. 16) is carried out independently of the patch detection ATR control (FIG. 11). For that reason, in the case of N=200, the density correction control is always carried out at a certain frequency, i.e., every printing of 200 sheets. In Comparison Example 2, the supply control is carried out similarly as in Embodiment 1 described with reference to FIG. 11, and therefore, also in Comparison Example 2, the execution frequency of the patch detection ATR control is changed depending on the change rate ΔV.

Figure 20:
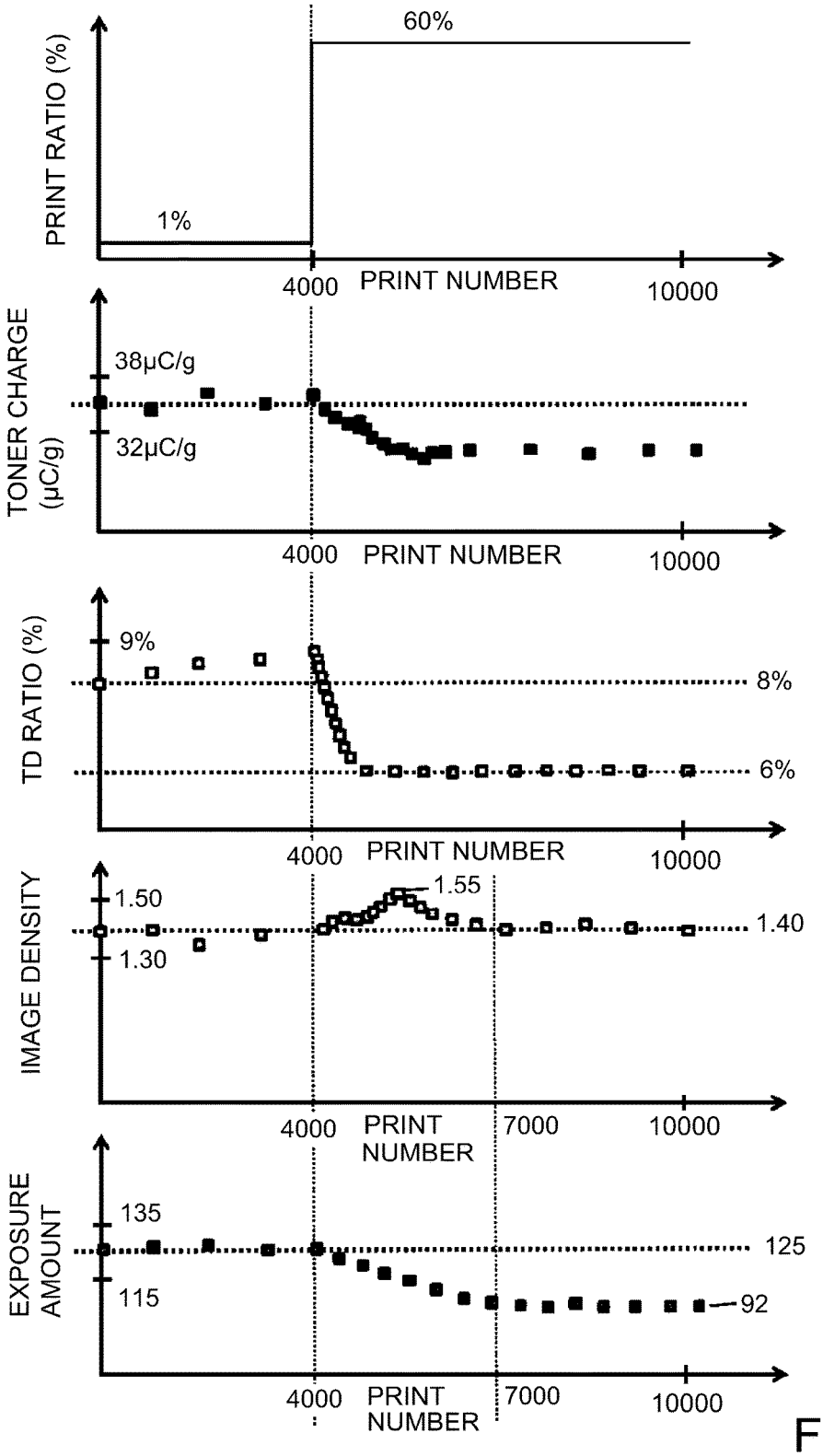
FIG. 20 is an illustration showing changes in print ratio, toner charge amount, TD ratio, image density and exposure amount in the case where the printing is switched from the printing of the low print ratio image to the printing of the high print ratio image in Comparison Example 2.
Figure 21:
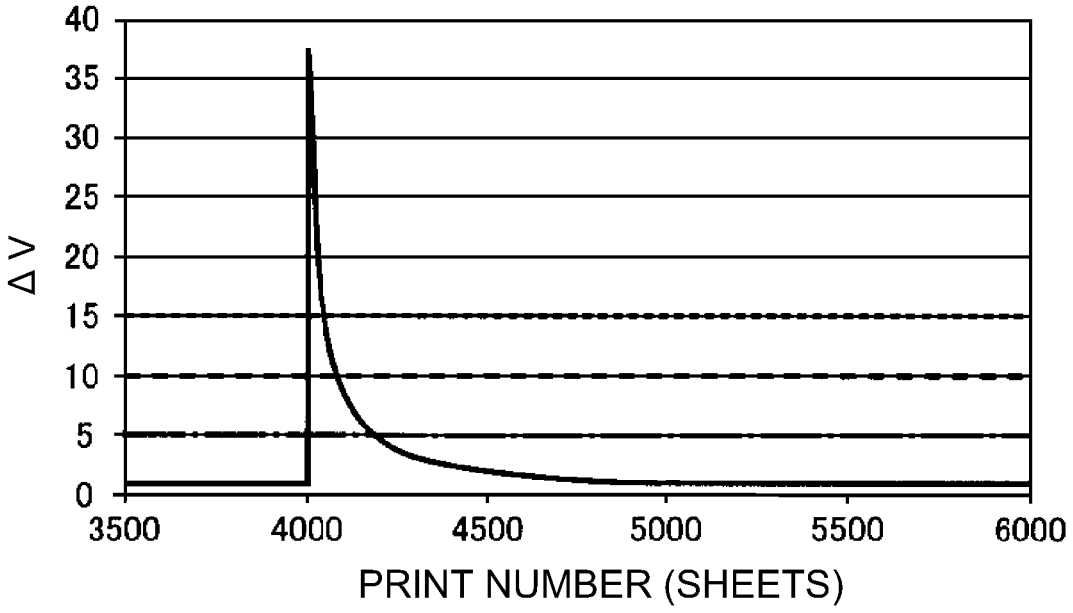
FIG. 21 is a graph showing a fluctuation of a print ratio change rate ΔV in an example of FIG. 20.

FIG. 20 includes graphs showing changes in print ratio, toner charge amount, TD ratio, image density of the output image, and exposure amount in Comparison Example 2 in the case where the 1%-print ratio image is printed from an initial stage (first sheet) to 4000-th sheets and the 60%-print ratio image is printed from 4001-th sheet to 10000-th sheet. FIG. 21 is a graph showing a change in change rate ΔV from 3500-th sheet to the 6000-th sheet in that case.

As shown in FIG. 20, from the initial stage to the 4000-th sheet in the printing of the 1%-print ratio image, similarly as in the case of Embodiment 1 (FIG. 12), the toner charge amount can be suppressed by the increase in target TD ratio by the patch detection ATR control. Then, as shown in FIG. 21, immediately after the print ratio is switched from 1% to 60% for the 4001-th sheet, the change rate ΔV abruptly increases and exceeds the third change rate threshold Vth3=15, so that the patch detection ATR control is executed at a high frequency every printing of 10 sheets. However, the degree of the change in change rate ΔV in this case is larger than that in the case of FIG. 13. For that reason, as shown in FIG. 20, the lowering in toner charge amount is intended to be suppressed by quickly lowering the target TD ratio, but the change in change rate ΔV is excessively large, and therefore, the suppression of the lowering in toner charge amount by lowering the target TD ratio cannot be effected in time. Further, the target TD ratio reaches 6% which is the lower limit thereof, so that thereafter the lowering in toner charge amount becomes more abrupt. On the other hand, although an increase amount of the image density which cannot be suppressed by the patch detection ATR control is alleviated by lowering the exposure amount of the exposure device 3 by the density correction control, the execution frequency of the density correction control is constant at every printing of 200 sheets, and therefore the density correction control cannot sufficiently catch up with the alleviation of the increase in image density. As a result, about 7000 sheets are required until the image density of the output image is stabilized, so that the image density of the output image in that period increases up to 1.55.

7-2. Embodiment 2 (this Embodiment)

Figure 22:
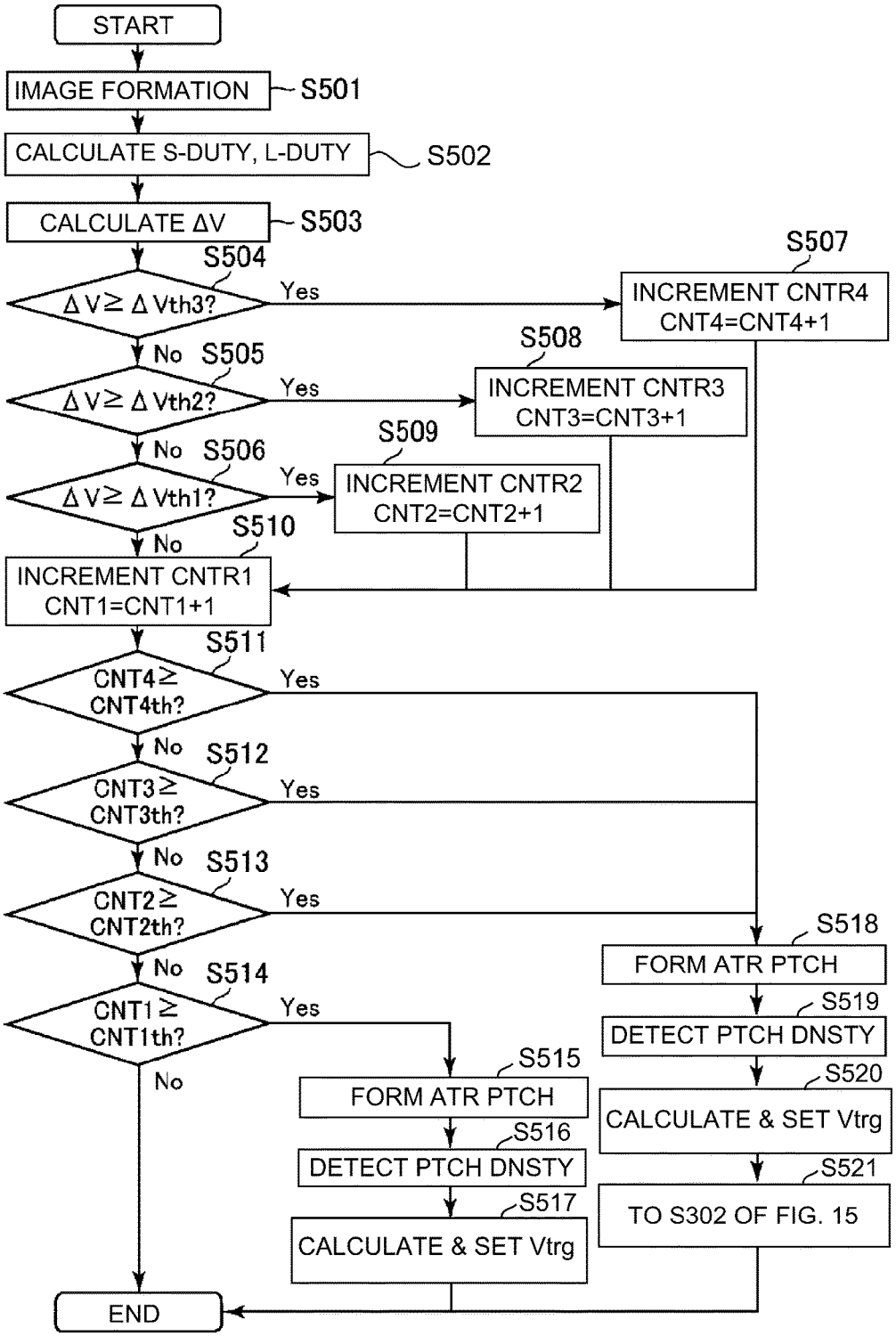
FIG. 22 is a flowchart of supply control (including a process of changing an execution frequency of density correction control) in Embodiment 2.

FIG. 22 is a flowchart for illustrating supply control (including the process of changing the execution frequency of the density correction control) in this embodiment. In this embodiment, in the case where either one of change rate counters which are incremented by one in the case of roughly 5<ΔV is not less than the associated threshold, irrespective of the count value of the density correction counter CNTrt, the density correction control is carried out in addition to the patch detection ATR control. That is, in this embodiment, when whether or not the patch detection ATR control should be executed is discriminated, whether or not the density correction control should be executed is discriminated. As a result, in this embodiment, the density correction control and the patch detection ATR control are not completely independent of each other. In the following, description will be specifically described.

Processes of S501-S510 in FIG. 22 are the same as those of S201-S210 in FIG. 11.

Thereafter, the supply controller 34 of the printer controller 15 compares the first to fourth counters CNT1, CNT2, CNT3 and CNT4 with the first to fourth counter thresholds CNT1th, CNT2th, CNT3th and CNT4th, respectively (S511-S514). In this case, the counters are compared with the counter thresholds in an order from the fourth counter threshold CNT4th for which the counter is incremented by one when the change rate ΔV is larger than the fourth counter threshold CNT4th to the first counter threshold CNT1th for which the counter is incremented by one when the change rate ΔV is smaller than the first counter threshold CNT1th. Then, in the case where either one of the second to fourth counters CNT2 to CNT4 is not less than the associated one of the second to fourth counter thresholds CNT2th to CNT4th, the supply controller 34 executes the density correction control in the following manner. That is, subsequently to the patch detection ATR control, the supply controller 34 executes the density correction control irrespective of the count value of the density correction counter CNTrt (S518-S521). In the case where the density correction control is executed as described above, the supply controller resets the density correction counter CNTrt to zero. On the other hand, in the case where the first counter CNT1 is not less than the first counter threshold CNT1th, the supply controller 34 executes only the patch detection ATR control similarly as in Embodiment 1 (S515-S517).

Thus, in this embodiment, only in the case where the degree of the change in print ratio is large and the patch detection ATR control is executed depending on the print ratio, the density correction control is executed in addition to the patch detection ATR control.

Figure 23:
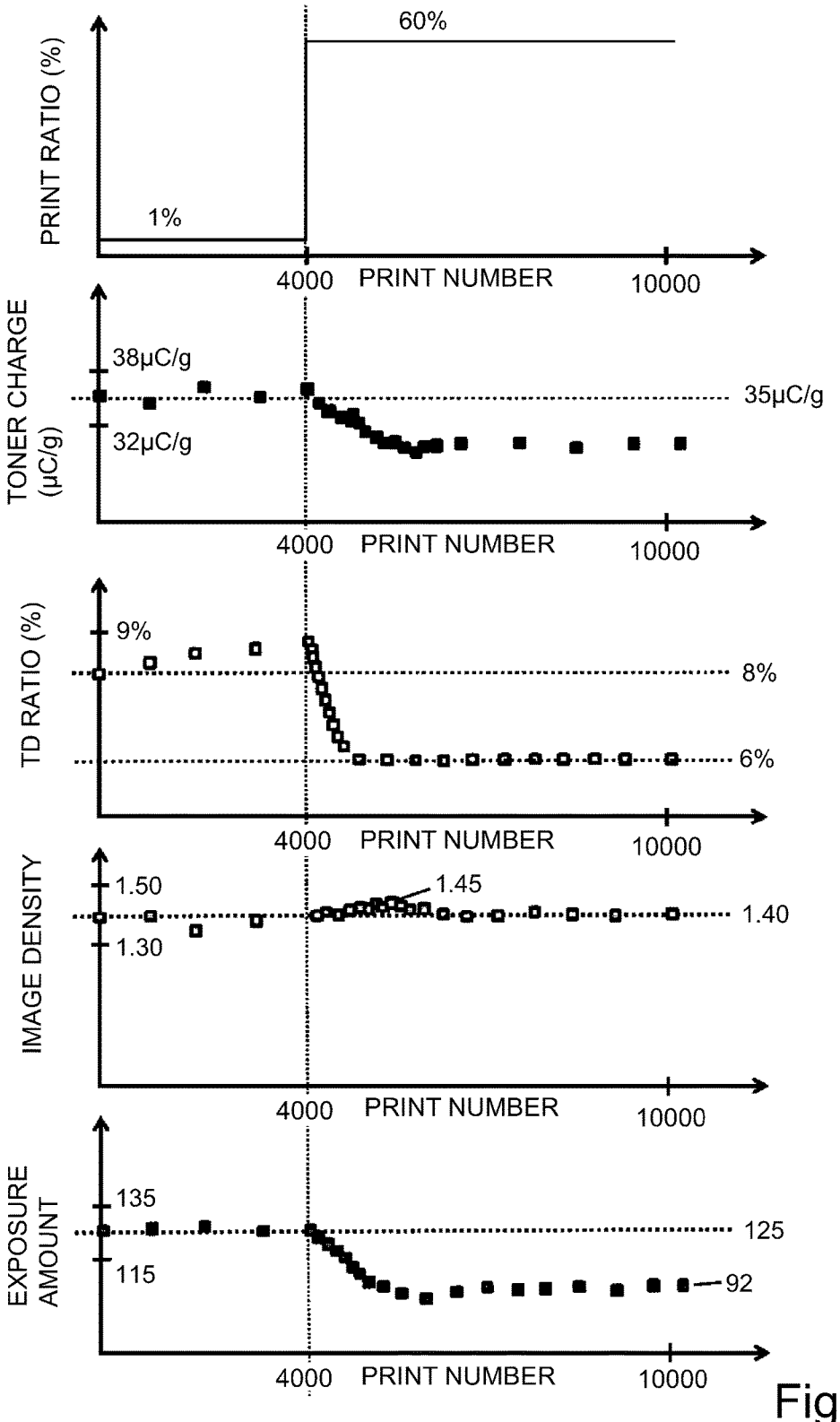
FIG. 23 is an illustration showing changes in print ratio, toner charge amount, TD ratio, image density and exposure amount in the case where the printing is switched from the printing of the low print ratio image to the printing of the high print ratio image in Embodiment 2.

FIG. 23 includes graphs showing changes in print ratio, toner charge amount, TD ratio image density of the output image, and exposure amount in the case where printing of 1%-print ratio image is carried out from a first sheet (IT stage) to 4000-th sheet and then printing of 60%-print ratio image is carried out from 4001-th sheet to 10000-th sheet. Further, a change in change rate ΔV in these cases from the 3500-th sheet to the 6000-th sheet is as shown in FIG. 21.

As shown in FIG. 23, similarly as in the cases of Embodiment 1 (FIG. 12) and Comparison Example 2 (FIG. 20), as regards from the first sheet to the 4000-th sheet in the printing of the 1%-print ratio image, the increase in toner charge amount can be suppressed by an increase in target TD ratio through the patch detection ATR control. Thereafter, as shown in FIG. 21, the change rate ΔV abruptly increases immediately after the print ratio switches from 1% to 60% after 4000 sheets and exceeds the third change rate threshold Vth3=15. As a result, the patch detection ATR control is carried out at a high frequency of every printing of 10 sheets, so that the lowering in toner charge amount with the change in print ratio is quickly suppressed. Further, together with the patch detection ATR control, the density correction control is executed at a high frequency of every printing of 10 sheets, so that the exposure amount is quickly lowered compared with the case of Comparison Example 1 (FIG. 20). As a result, similarly as in Comparison Example 2, although the target TD ratio reaches 6% which is the lower limit thereof and thus the toner charge amount lowers, the image density of the output image is stabilized at 1.45 as the maximum density.

Table 4 shows the number of times of execution of each of the patch detection ATR control and the density correction control in a period from a print number of 4001 sheets to a print number of 4500 sheets in each of Comparison Example 2 and this embodiment (Embodiment 2) in the case where the printing is switched from the printing of the 1%-print ratio image to the printing of the 60%-print ratio image after 4000 sheets.

TABLE 4

| | PDAEN*1 | DCCEN*2 |
|---|---|---|
| COMP. EX. 2 | 10 times | 3 times |
| EMB. 2 | 10 times | 10 times |

*1"PDAEN" is the patch detection ATR control execution number.
*2"DCCEN" is the density correction control execution number.

As shown in Table 4, in Comparison Example 2, the patch detection ATR control is carried out ten times and the density correction control is carried out three times, but on the other hand, in this embodiment, the patch detection ATR control is carried out ten times and the density correction control is carried out ten times. As a result, in this embodiment, the fluctuation in image density which cannot be completely suppressed by the control of the toner charge amount depending on the TD ratio is effectively suppressed by the correction of the exposure amount of the exposure device 3, so that the image density of the output image can be stabilized.

Other Embodiments

As described above, the present invention was described in accordance with specific embodiments, but is not limited to the above-described embodiments.

In the above-described embodiments, the reference toner image is detected on the photosensitive member, but the present invention is not limited thereto. For example, the reference toner image is transferred on the intermediary transfer member or the recording material and then may also be detected on the intermediary transfer member or the recording material.

Further, in the above-described embodiments, description was made by paying attention to suppression of the image density of the output image which is particularly conspicuous when the printing is switched from the printing of the low print ratio image to the printing of the high print ratio image. However, according to the control in accordance with the present invention, suppression of the image density of the output image when the printing is switched from the printing of the low print ratio image to the printing of the high print ratio image can be intended to be realized by changing the execution frequency of the patch detection ATR control and the execution frequency of the density correction control depending on the change in print ratio in a predetermined period. In this case, the threshold of the change in print ratio for discriminating the switching of the printing from the low print ratio image printing to the high print ratio image printing and the threshold of the change in print ratio for discriminating the switching of the printing from the high print ratio image printing to the low print ratio image printing may be the same or may be different from each other.

Further, in the above-described embodiments, as the supply control, the triple control type was employed, but the supply of the supplying developer by the feed-forward control using the video count is not essential to the present invention. The present invention is applicable thereto when the supplying developer is supplied so that the toner density detected by the toner density detecting means approaches the target value, and on the basis of the image density of the reference toner image detected by the image density detecting means, the target value is adjusted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-138909 filed on Jul. 13, 2016, which is hereby incorporated by reference herein in its entirety.

What is claimed is:

1. An image forming apparatus comprising:

an image bearing member;

a developing device configured to develop, with a developer containing toner and a carrier, an electrostatic latent image formed on said image bearing member;

a toner content detecting portion configured to detect a toner content in the developer in said developing device;

a supplying device configured to supply the toner to said developing device on the basis of an output of said toner content detecting portion to maintain the toner content in the developer in said developing device at a target value;

a calculating portion configured to calculate an image ratio of an image to be outputted;

a toner image detecting portion configured to detect a density of a toner image formed by said developing device;

an adjusting portion configured to adjust the target value on the basis of a result of detection of a density of a detection toner image by said toner image detecting portion, the detection toner image being formed by said developing device; and a controller configured to control an execution frequency of said adjusting portion so that said adjusting portion effects adjustment after a number of times of image formation after occurrence of a high change rate of the image ratio that is greater than a predetermined change rate reaches a first value, and said adjusting portion effects adjustment after the number of times of image formation after occurrence of a low change rate of the image ratio that is lower than the predetermined change rate reaches a second value greater than the first value.

2. An image forming apparatus according to claim 1, wherein said controller acquires the change rate by comparing an average value of a calculation result of calculating means configured to calculate a first sheet number with an average value of a calculation result of calculating means configured to calculate a second sheet number greater than the first sheet number.

3. An image forming apparatus according to claim 1, further comprising image density detecting means configured to detect an image density of a reference toner image formed on said image bearing member in order to control setting of an operation for forming the toner image, wherein said controller executes an adjusting operation for adjusting the setting on the basis of the image density of the reference toner image detected by said image density detecting means and changes execution timing of the adjusting operation on the basis of information on the change rate.

4. An image forming apparatus according to claim 1, wherein the target value is adjusted between a set upper limit and a set lower limit.

5. An image forming apparatus according to claim 1, wherein said calculating portion calculates a video count value per image sheet.

6. An image forming apparatus according to claim 5, further comprising a counting portion configured to count each of the number of times of image formation after occurrence of the high change rate of the image ratio and the number of times of image formation after occurrence of the low change rate of the image ratio.

7. An image forming apparatus according to claim 1, wherein said controller controls execution by said adjusting portion after the number of times of image formation after occurrence of a high increase rate of the image ratio that is greater than a predetermined increase rate reaches a first value, and controls execution by said adjusting portion after the number of times of image formation after occurrence of a low increase rate of the image ratio that is lower than the predetermined increase rate reaches a second value greater than the first value.

8. An image forming apparatus according to claim 1, wherein said controller controls execution by said adjusting portion after the number of times of image formation after occurrence of a high decrease rate of the image ratio that is greater than a predetermined decrease rate reaches a first value, and controls execution by said adjusting portion after the number of times of image formation after occurrence of a low decrease rate of the image ratio that is less than the predetermined decrease rate reaches a second value greater than the first value.

9. An image forming apparatus comprising:

an image bearing member;

a developing device configured to develop, with a developer containing toner and a carrier, an electrostatic latent image formed on said image bearing member;

a toner content detecting portion configured to detect a toner content in the developer in said developing device;

a supplying device configured to supply the toner to said developing device on the basis of an output of said toner content detecting portion to maintain the toner content in the developer in said developing device at a target value;

a calculating portion configured to calculate an image ratio of an image to be outputted;

a toner image detecting portion configured to detect a density of a toner image formed by said developing device;

an adjusting portion configured to adjust the target value on the basis of a result of detection of a density of a detection toner image by said toner image detecting portion, the detection toner image being formed by said developing device; and a controller configured to control an execution frequency of said adjusting portion so that said adjusting portion effects adjustment after a number of times of image formation after occurrence of a high change amount of the image ratio that is greater than a predetermined change amount reaches a first value, and said adjusting portion effects adjustment after the number of times of image formation after occurrence of a low change amount of the image ratio that is lower than the predetermined change amount reaches a second value greater than the first value.

10. An image forming apparatus according to claim 9, further comprising image density detecting means configured to detect an image density of a reference toner image formed on said image bearing member in order to control setting of an operation for forming the toner image, wherein said controller executes an adjusting operation for adjusting the setting on the basis of the image density of the reference toner image detected by said image density detecting means and changes execution timing of the adjusting operation on the basis of information on the change amount.

11. An image forming apparatus according to claim 9, wherein the target change amount is adjusted between a set upper limit and a set lower limit.

12. An image forming apparatus according to claim 9, wherein said calculating portion calculates a video count value per image sheet.

13. An image forming apparatus according to claim 12, further comprising a counting portion configured to count each of the number of times of image formation after occurrence of the high change amount of the image ratio and the number of times of image formation after occurrence of the low change amount of the image ratio.

14. An image forming apparatus according to claim 9, wherein said controller controls execution by said adjusting portion after the number of times of image formation after occurrence of a high increase amount of the image ratio that is greater than a predetermined increase amount reaches a first value, and controls execution by said adjusting portion after the number of times of image formation after occurrence of a low increase amount of the image ratio that is lower than the predetermined increase amount reaches a second value greater than the first value.

15. An image forming apparatus according to claim 9, wherein said controller controls execution by said adjusting portion after the number of times of image formation after occurrence of a high decrease amount of the image ratio that is greater than a predetermined decrease amount reaches a first value, and controls execution by said adjusting portion after the number of times of image formation after occurrence of a low decrease amount of the image ratio that is less than the predetermined decrease amount reaches a second value greater than the first value.

16. An image forming apparatus comprising:

an image bearing member;

a developing device configured to develop, with a developer containing toner and a carrier, an electrostatic latent image formed on said image bearing member;

a toner content detecting portion configured to detect a toner content in the developer in said developing device;

a supplying device configured to supply the toner to said developing device on the basis of an output of said toner content detecting portion to maintain the toner content in the developer in said developing device at a target value;

a calculating portion configured to calculate an image ratio of an image to be outputted;

a toner image detecting portion configured to detect a density of a toner image formed by said developing device;

an adjusting portion configured to adjust the target value on the basis of a result of detection of a density of a detection toner image by said toner image detecting portion, the detection toner image being formed by said developing device; and a controller configured to control an execution frequency of said adjusting portion so that the execution frequency of said adjusting portion when images with a high change rate of the image ratio that is greater than a predetermined change rate are continuously outputted is higher than the execution frequency of said adjusting portion when images with a low change rate of the image ratio that is lower than the predetermined change rate are continuously outputted.

17. An image forming apparatus according to claim 16, wherein said controller acquires the change rate by comparing an average value of a calculation result of calculating means configured to calculate a first sheet number with an average value of a calculation result of calculating means configured to calculate a second sheet number greater than the first sheet number.

18. An image forming apparatus according to claim 16, wherein the target value is adjusted between a set upper limit and a set lower limit.

19. An image forming apparatus according to claim 16, wherein said calculating portion calculates a video count value per image sheet.

20. An image forming apparatus according to claim 16, wherein said controller controls the execution frequency of said adjusting portion so that an execution frequency of said adjusting portion when images with a high decrease rate of the image ratio that is higher than a predetermined decrease rate are continuously outputted is higher than an execution frequency of said adjusting portion when images with a low decrease rate of the image ratio that is lower than the predetermined decrease rate are continuously outputted.

21. An image forming apparatus according to claim 16, wherein said controller controls the execution frequency of said adjusting portion so that an execution frequency of said adjusting portion when images with a high increase rate of the image ratio that is higher than a predetermined increase rate are continuously outputted is higher than an execution frequency of said adjusting portion when images with a low increase rate of the image ratio that is lower than the predetermined increase rate are continuously outputted.

22. An image forming apparatus comprising:

an image bearing member;

a developing device configured to develop, with a developer containing toner and a carrier, an electrostatic latent image formed on said image bearing member;

a toner content detecting portion configured to detect a toner content in the developer in said developing device;

a supplying device configured to supply the toner to said developing device on the basis of an output of said toner content detecting portion to maintain the toner content in the developer in said developing device at a target value;

a calculating portion configured to calculate an image ratio of an image to be outputted;

a toner image detecting portion configured to detect a density of a toner image formed by said developing device;

an adjusting portion configured to adjust the target value on the basis of a result of detection of a density of a detection toner image by said toner image detecting portion, the detection toner image being formed by said developing device; and a controller configured to control an execution frequency of said adjusting portion so that the execution frequency of said adjusting portion when images with a high change amount of the image ratio that is greater than a predetermined change amount are continuously outputted is higher than the execution frequency of said adjusting portion when images with a low change amount of the image ratio that is less than the predetermined change amount are continuously outputted.

23. An image forming apparatus according to claim 22, wherein the target value is adjusted between a set upper limit and a set lower limit.

24. An image forming apparatus according to claim 22, wherein said calculating portion calculates a video count value per image sheet.

25. An image forming apparatus according to claim 22, wherein said controller controls the execution frequency of said adjusting portion so that the execution frequency of said adjusting portion when images with a high decrease amount of the image ratio that is greater than a predetermined decrease amount are continuously outputted is higher than the execution frequency of said adjusting portion when images of a low decrease amount of the image ratio that is lower than a predetermined decrease amount are continuously outputted.

26. An image forming apparatus according to claim 22, wherein said controller controls the execution frequency of said adjusting portion so that the execution frequency of said adjusting portion when images with a high increase amount of the image ratio that is greater than a predetermined increase amount are continuously outputted is higher than the execution frequency of said adjusting portion when images with a low increase amount of the image ratio that is less than the predetermined increase amount are continuously outputted.

27. An image forming apparatus comprising:

an image bearing member;

a developing device configured to develop, with a developer containing toner and a carrier, an electrostatic latent image formed on said image bearing member;

a toner content detecting portion configured to detect a toner content in the developer in said developing device;

a supplying device configured to supply the toner to said developing device on the basis of an output of said toner content detecting portion to maintain the toner content in the developer in said developing device at a target value;

a calculating portion configured to calculate an image ratio of an image to be outputted;

a toner image detecting portion configured to detect a density of a toner image formed by said developing device;

an adjusting portion configured to adjust the target value on the basis of a result of detection of a density of a detection toner image by said toner image detecting portion, the detection toner image being formed by said developing device; and a controller configured to control an execution frequency of said adjusting portion so that a number of times of image formation from last execution by said adjusting portion when said adjusting portion effects execution in a case that subsequently after an image with a first image ratio is continuously outputted on a predetermined number of sheets, an image with a second image ratio higher in change rate than the first image ratio by a predetermined amount is less than a number of times of image formation from last execution by said adjusting portion when said adjusting portion effects execution in a case that the image with the first image ratio is continuously outputted.

28. An image forming apparatus according to claim 27, wherein the first image ratio is 1%, and the second image ratio is 60%.

29. An image forming apparatus comprising:

an image bearing member;

a developing device configured to develop, with a developer containing toner and a carrier, an electrostatic latent image formed on said image bearing member;

a toner content detecting portion configured to detect a toner content in the developer in said developing device;

a supplying device configured to supply the toner to said developing device on the basis of an output of said toner content detecting portion to maintain the toner content in the developer in said developing device at a target value;

a calculating portion configured to calculate an image ratio of an image to be outputted;

a toner image detecting portion configured to detect a density of a toner image formed by said developing device;

an adjusting portion configured to adjust the target value on the basis of a result of detection of a density of a detection toner image by said toner image detecting portion, the detection toner image being formed by said developing device; and a controller configured to control an execution frequency of said adjusting portion so that a number of times of image formation from last execution of said adjusting portion when said adjusting portion effects execution in a case that subsequently after an image with a first image ratio is continuously outputted on a predetermined number of sheets, an image with a second image ratio greater in change amount than the first image ratio by a predetermined amount is less than a number of times of image formation from last execution of said adjusting portion when said adjusting portion effects execution in a case that the image with the first image ratio is continuously outputted.

30. An image forming apparatus according to claim 29, wherein the first image ratio is 1%, and the second image ratio is 60%.

31. An image forming apparatus capable of executing a continuous image forming job for continuously forming an image on a plurality of recording materials, comprising:

an image forming portion including:

an image bearing member, a developing device configured to develop, with toner, an electrostatic latent image formed on said image bearing member, and a supplying portion configured to supply the toner to said developing device;

a detecting unit configured to detect a density of a toner image formed by said image forming portion;

a determining portion configured to determine a toner supply amount to be supplied to said developing device by said supplying portion based on information regarding a toner consumption amount for images formed on the plurality of recording materials in the continuous image forming job; and an executing portion configured to cause said image forming portion to form a reference toner image to adjust the toner consumption amount determined by said determining portion, to cause said detecting unit to detect the density of the reference toner image formed by said image forming portion, and to execute an adjusting operation for adjusting the toner supply amount based on the density detected by said detection unit, wherein said executing portion is capable of selectively executing an operation in one mode from among a plurality of modes that include a first mode in which the adjusting operation is executed when a sheet number of the recording materials on which the toner images are formed by said image forming portion reaches a first predetermined number regardless of an increase rate of the toner consumption amount for images formed on the plurality of recording materials in the continuous image forming job, and a second mode in which the adjusting operation is executed when the sheet number of the recording materials on which the toner images formed by said image forming portion reaches a second predetermined number less than the first predetermined number in a case where the increase rate is equal to or greater than a predetermined value.

32. An image forming apparatus according to claim 31, wherein said executing portion is capable of selectively executing the operation in one mode from among the plurality of modes that include the first mode, the second mode in which the adjusting operation is executed when the sheet number of the recording materials on which the toner images are formed by said image forming portion reaches the second predetermined number in a case where the increase rate is equal to or greater than the predetermined value and less than a second predetermined value greater than the predetermined value, and a third mode in which the adjusting operation is executed when the sheet number of the recording materials on which the toner images are formed by said image forming portion reaches a third predetermined number less than the second predetermined number in a case where the increase rate is greater than the second predetermined value.

33. An image forming apparatus according to claim 31, wherein the increase rate is a rate of an average value of the toner consumption amount for images formed on a first number of recording materials during a first period in the continuous image forming job to an average value of the toner consumption amount for images formed on a second number less than the first number of recording materials during a second period after a beginning of the first period in the continuous image forming job.

34. An image forming apparatus according to claim 33, wherein the first and second periods include an overlapping period therebetween.

35. An image forming apparatus according to claim 31, wherein the increase rate is a rate of an average value of the toner consumption amount for images formed on a first number of recording materials during a first period in the continuous image forming job to an average value of the toner consumption amount for images formed on a second number equal to the first number of recording materials during a second period after a beginning of the first period in the continuous image forming job.

36. An image forming apparatus according to claim 35, wherein the first and second periods include an overlapping period therebetween.

37. An image forming apparatus according to claim 31, further comprising:

a calculating portion configured to calculate the toner consumption amount for images formed on the plurality of recording materials in the continuous image forming, said calculating portion calculating the toner consumption amount based on the toner consumption amount for images formed on an image ratio of an image to be formed by said image forming portion in the continuous image forming job.

38. An image forming apparatus according to claim 31, further comprising:

a second detecting unit configured to detect a toner content in the developer in said developing device, wherein said determining portion determines the toner supply amount to be supplied to said developing device by said supplying portion based on the information regarding the toner consumption amount for images formed on the plurality of recording materials in the continuous image forming job and the toner content detected by said second detecting unit.

39. An image forming apparatus according to claim 31, further comprising:

an image transfer member on which the toner image formed by said image forming portion is transferred from said image bearing member, wherein said detecting unit detects the density of the toner image formed on said image transfer member.

* * * * *